US009201393B2

(12) United States Patent
Furuichi et al.

(10) Patent No.: US 9,201,393 B2
(45) Date of Patent: Dec. 1, 2015

(54) TONER CONTAINER, PROCESS CARTRIDGE, AND IMAGE FORMING APPARATUS

(71) Applicants: Yuusuke Furuichi, Osaka (JP); Rie Mitani, Hyogo (JP); Takafumi Miyazaki, Osaka (JP); Hidekazu Shono, Hyogo (JP); Osamu Saito, Osaka (JP); Ryuji Inoue, Hyogo (JP); Tetsumaru Fujita, Hyogo (JP); Kei Hasegawa, Hyogo (JP); Yasuhide Ohkubo, Osaka (JP); Tomofumi Yoshida, Osaka (JP); Shintaro Yamada, Osaka (JP); Yoshihiro Fukuhata, Hyogo (JP); Ryouhei Ohi, Kyoto (JP)

(72) Inventors: Yuusuke Furuichi, Osaka (JP); Rie Mitani, Hyogo (JP); Takafumi Miyazaki, Osaka (JP); Hidekazu Shono, Hyogo (JP); Osamu Saito, Osaka (JP); Ryuji Inoue, Hyogo (JP); Tetsumaru Fujita, Hyogo (JP); Kei Hasegawa, Hyogo (JP); Yasuhide Ohkubo, Osaka (JP); Tomofumi Yoshida, Osaka (JP); Shintaro Yamada, Osaka (JP); Yoshihiro Fukuhata, Hyogo (JP); Ryouhei Ohi, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/336,108

(22) Filed: Jul. 21, 2014

(65) Prior Publication Data

US 2015/0063865 A1 Mar. 5, 2015

(30) Foreign Application Priority Data

Aug. 30, 2013 (JP) ..... 2013-179814
Sep. 10, 2013 (JP) ..... 2013-187384

(51) Int. Cl.

| | |
|---|---|
| ***G03G 21/16*** | (2006.01) |
| ***G03G 15/08*** | (2006.01) |
| ***G03G 21/18*** | (2006.01) |

(52) U.S. Cl.
CPC ..... *G03G 21/1814* (2013.01); *G03G 15/0865* (2013.01); *G03G 15/0874* (2013.01)

(58) Field of Classification Search
CPC ..... G03G 21/1814; G03G 21/1853; G03G 15/0837; G03G 15/0865
USPC ..... 399/111, 119; 222/DIG. 1
See application file for complete search history.

(56) References Cited

U.S. PATENT DOCUMENTS

| | | | | |
|---|---|---|---|---|
| 6,898,405 | B2 * | 5/2005 | Matsumoto et al. | 399/262 |
| 2013/0051864 | A1 | 2/2013 | Mitani et al. | |
| 2013/0183065 | A1 | 7/2013 | Nakamura et al. | |
| 2013/0236197 | A1 | 9/2013 | Yoshida et al. | |
| 2013/0236209 | A1 | 9/2013 | Furuichi | |

FOREIGN PATENT DOCUMENTS

| | | |
|---|---|---|
| JP | 4-066980 | 3/1992 |
| JP | 7-044006 | 2/1995 |
| JP | 8-171334 | 7/1996 |
| JP | 8-272204 | 10/1996 |
| JP | 8-272205 | 10/1996 |
| JP | 10-020647 | 1/1998 |
| JP | 2002-006604 | 1/2002 |

* cited by examiner

*Primary Examiner* — Hoang Ngo
(74) *Attorney, Agent, or Firm* — Oblon, McClelland, Maier & Neustadt, L.L.P.

(57) ABSTRACT

A toner container includes a substantially tetrahedral toner-containing portion having an openable edge to discharge toner contained in the toner-containing portion, and a reference fold along which the toner container is foldable after the openable edge is opened. The reference fold extends from the openable edge and is provided on medians of two triangular faces of the toner-containing portion adjoining each other along the openable edge.

13 Claims, 21 Drawing Sheets

TONER CONTAINER, PROCESS CARTRIDGE, AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2013-179814 filed on Aug. 30, 2013 and 2013-187384 filed on Sep. 10, 2013, in the Japan Patent Office, the entire disclosure of which is hereby incorporated by reference herein.

BACKGROUND

1. Technical Field

Embodiments of the present invention generally relate to a toner container and a process cartridge used in an image forming apparatus, such as a copier, a printer, a facsimile machine, or a multifunction machine having at least two of copying, printing, facsimile transmission, plotting, and scanning capabilities; and the image forming apparatus.

2. Description of the Related Art

There are electrophotographic image forming apparatuses that employ a toner cartridge, serving as a toner container, which is removably installable in a process cartridge (i.e., an image forming unit) or in the image forming apparatus to supply toner to the image forming apparatus.

Additionally, there are toner cartridges that are installable in the process cartridge or the apparatus and folded and compressed after toner is discharged therefrom into a toner chamber in the process cartridge or the apparatus. Then, the used toner cartridges are kept inside the process cartridge or the apparatus.

SUMMARY

According to an embodiment of the present invention, a toner container includes a substantially tetrahedral toner-containing portion having an openable edge to discharge toner contained in the toner-containing portion, and a reference fold along which the toner container is foldable after the openable edge is opened. The reference fold extends from the openable edge and is provided on medians of two triangular faces of the toner-containing portion adjoining each other along the openable edge.

Another embodiment provides a process cartridge refillable with toner supplied from the above-described toner container. The process cartridge includes a container storage compartment to accommodate the toner container, and a compressor to contact and compress the toner container accommodated in the container storage compartment.

Yet another embodiment provides an image forming apparatus including an apparatus body in which the above-described process cartridge is removably installed.

Yet another embodiment provides an image forming apparatus that includes a container storage compartment to accommodate the above-described toner container and a compressor to contact and compress the toner container accommodated in the container storage compartment.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
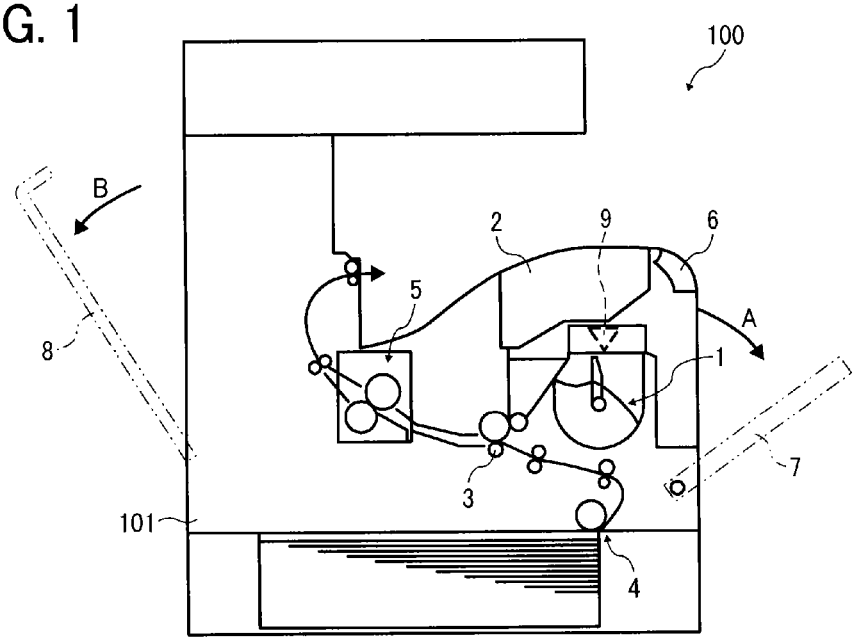
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described.

The present embodiment concerns a toner cartridge serving as a toner container used in an electrophotographic image forming apparatus and includes the following aspects. A toner-containing portion of the toner cartridge is substantially tetrahedral in shape, and one of edges of the tetrahedral toner-containing portion is opened to supply toner therefrom to the process cartridge. After toner is discharged therefrom, the tetrahedral toner-containing portion is folded flat along medians of triangular faces extending from the opened edge to make space for another toner cartridge.

In embodiments of the present invention described below, toner can be either pulverized toner or polymerized toner. The toner usable in the embodiments described below includes, as an external additive, silica including silicone oil. For example, silica including silicone oil can be externally added to toner as follows. Add 2 parts of hydrophobic silica RY 50 from Aerosil Co. Ltd. to 100 parts of pulverized toner or polymerized toner, and mix it for 5 minutes at a peripheral velocity of about 40 millimeters per second by a 20-liter Henschel mixer. Then, sieve the mixture with an opening size of 75μ.

FIG. 1 is a schematic view of an image forming apparatus 100 that in the present embodiment is a monochrome printer, for example.

The image forming apparatus 100 includes an apparatus body 101, a process cartridge 1 in which toner is contained, a writing device 2, a transfer roller 3 serving as a transfer member, a sheet feeder 4, and a fixing device 5. The image forming apparatus 100 forms images according to typical electrophotographic image forming processes.

A front cover 7 and a rear cover 8 that are openable and closable are provided respectively on a front side and a rear side of the apparatus body 101. Components of the image forming apparatus 100, such as the process cartridge 1, the writing device 2, the transfer roller 3, the sheet feeder 4, and the fixing device 5, are basically disposed in the apparatus body 101. The process cartridge 1, the writing device 2, the transfer roller 3, the sheet feeder 4, and the fixing device 5 perform the image forming processes, controlled by a controller. Accordingly, these components transmit and receive data to and from the controller via a signal line. A display panel 6 is provided above the front cover 7 on the front side of the apparatus body 101. The display panel 6 is connected to the controller via the signal line or the like and displays various types of information to users. For example, when replacement of the process cartridge 1 is necessary, the controller causes the display panel 6 to indicate it. When the replacement of the process cartridge 1 is instructed, the user opens the front cover 7 of the apparatus body 101 in the direction indicated by arrow A shown in FIG. 1 and remove the process cartridge 1 from the apparatus body 101. When an occurrence of paper jam is reported on the display panel 6, the user opens the front cover 7 in the direction indicated by arrow A shown in FIG. 1, or opens the rear cover 8, which in on the opposite side of the front cover 7, in the direction indicated by arrow B shown in FIG. 1. Then, the user removes a jammed sheet.

It is to be noted that image forming apparatuses to which aspects of the present specification are applicable are not limited to the monochrome printer shown in FIG. 1 but include multicolor printers, monochrome or multicolor copiers, facsimile machines, and multifunction machines or MFPs.

Next, the process cartridge 1 is described below with reference to FIG. 2.

The process cartridge 1 can be refilled with toner supplied from a toner cartridge 9 described later, serving as the toner container, and removably installable in the apparatus body 101. The process cartridge 1 includes an image forming unit 10 whose main component is a drum-shaped photoreceptor 11, a container storage 19 to accommodate the toner cartridge, and a toner chamber 18 to contain toner supplied from the toner cartridge 9 inside the container storage 19. These components together constitute a modular unit (i.e., a process unit). The toner used in the present embodiment includes oil-containing silica as an external additive.

The image forming unit 10 further includes, around the photoreceptor 11, a charging roller 12, serving as a charging member, a developing roller 13, serving as a developer bearer, that contacts the photoreceptor 11 and supplies toner thereto, a supply roller 15 serving as a developer conveyance member, and a cleaning blade 17 serving as a cleaning member to remove toner from the photoreceptor 11 after image transfer. Around the developing roller 13, a regulation blade 14 is disposed as a developer regulator to regulate the amount of toner carried on the developing roller 13. The supply roller 15 supplies the toner transported from the toner chamber 18 to the developing roller 13.

Figure 2:
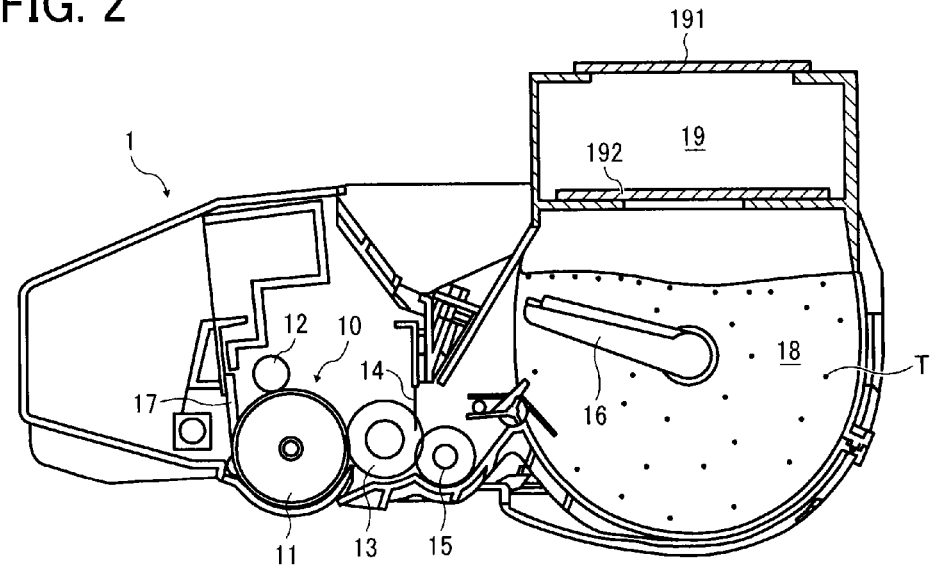
FIG. 2 is a schematic view of a process cartridge according to an embodiment.

The toner chamber 18 is a columnar space extending perpendicular to the surface of the paper on which FIG. 2 is drawn, and an agitator 16 is disposed in a center portion thereof. The agitator 16 transports toner to the supply roller 15 while agitating the toner. The process cartridge 1 forms toner images on the surface of the photoreceptor 11 according to typical electrophotographic image forming processes employing one-component developer.

It is to be noted that, although the process cartridge 1 employs one-component developer consisting essentially of toner in the present embodiment, alternatively, the process cartridge 1 may adapt to image forming processes employing two-component developer including toner and carrier.

Figure 3:
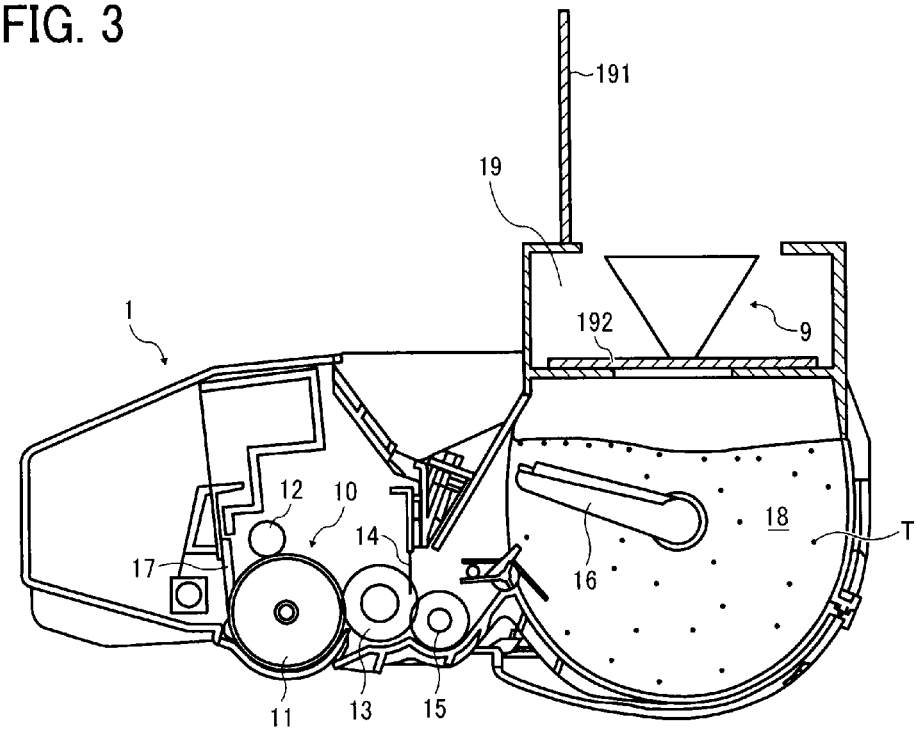
FIG. 3 is a schematic view of the process cartridge shown in FIG. 2 and a toner container set therein.

In the process cartridge 1, the container storage 19 is positioned above the toner chamber 18. An upper cover 191 that is openable and closable is provided above the container storage 19, and a lower cover 192 that partitions the container storage 19 from the toner chamber 18 is provided to a bottom of the container storage 19. The toner cartridge 9 can be set on the lower cover 192 in the container storage 19, from outside, in a state in which the upper cover 191 is open as shown in FIG. 3.

The process cartridge 1 is provided with a toner amount detector to detect the amount of toner remaining in the toner chamber 18. When the amount of toner falls below a predetermined amount, a message instructing toner supply appears on the display panel 6. Then, the user opens the upper cover 191 and can set the toner cartridge 9 on the lower cover 192 inside the container storage 19.

Figure 4:
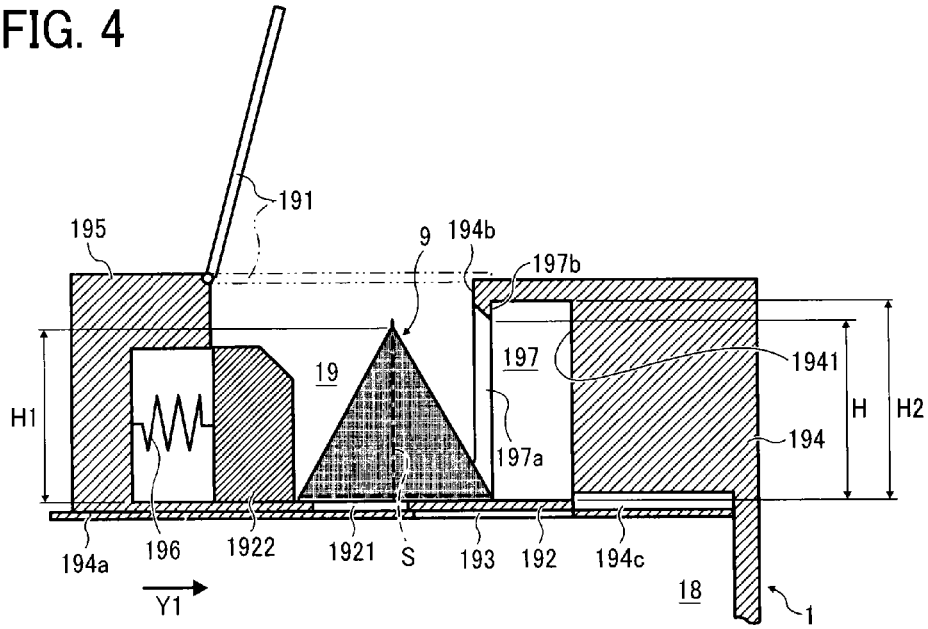
FIG. 4 is an enlarged cross-sectional view illustrating the toner container set in the process cartridge shown in FIG. 2 and a mechanism to compress the toner container.

As shown in FIG. 4, the container storage 19 is a compartment surrounded by a process cartridge body 194, a movable portion 195, the upper cover 191, and the lower cover 192. The movable portion 195 is movable in the direction indicated by arrow Y1 (hereinafter "compressing direction") to approach the process cartridge body 194 and the opposite direction to move away therefrom. Although the movable portion 195 is movable in horizontal directions in the present embodiment, the directions to approach and move away from the process cartridge body 194 are not limited thereto. For example, when the process cartridge body 194 and the movable portion 195 are arranged obliquely relative to a horizontal direction, the movable portion 195 is movable in oblique directions.

A bottom 194*a* of the process cartridge body 194 includes a communicating portion 193 communicating with an interior of the container storage 19. The process cartridge body 194 is provided with an opening 194*b* that is openably closed by the upper cover 191. The process cartridge body 194 includes a compressed container storage 197. In the present embodiment, a wall 1941 of the compressed container storage 197 is recessed (downstream) beyond the opening 194*b* in the direction compressing direction indicated by arrow Y1 in which the movable portion 195 moves for compression. The wall 1941 serves as a compressing portion.

A slit 194*c* (or a slot) extending horizontally is provided to the process cartridge body 194 and parallels the lower cover 192 and the bottom 194*a*. The slit 194*c* extends from the wall 1941 in the direction of movement of the movable portion 195 and accommodate a part of the lower cover 192 that moves integrally with the movable portion 195. A height H of an entrance 197*a* of the compressed container storage 197 is set such that the toner cartridge 9 before compressed having a height H1 can enter the compressed container storage 197. When compressed, the toner cartridge 9 has a length H3 (shown in FIG. 9). The height H of the entrance 197*a* is lower than the length H3. With this configuration, when the compressed toner cartridge 9 tilts or falls, the compressed toner cartridge 9 can be caught by an upper portion 197*b* of the entrance 197*a* and inhibited from falling onto the lower cover 192. Additionally, a height H2 of the wall 1941 is higher than the length H3 of the compressed toner cartridge 9 so that the toner cartridge 9 being compressed is not caught thereby and the compression is not hindered.

In the process cartridge 1, the movable portion 195 is provided with a compressing portion 1922 to contact and compress the toner cartridge 9. The compressed container storage 197 contains the compressed toner cartridge 9.

Figure 7:
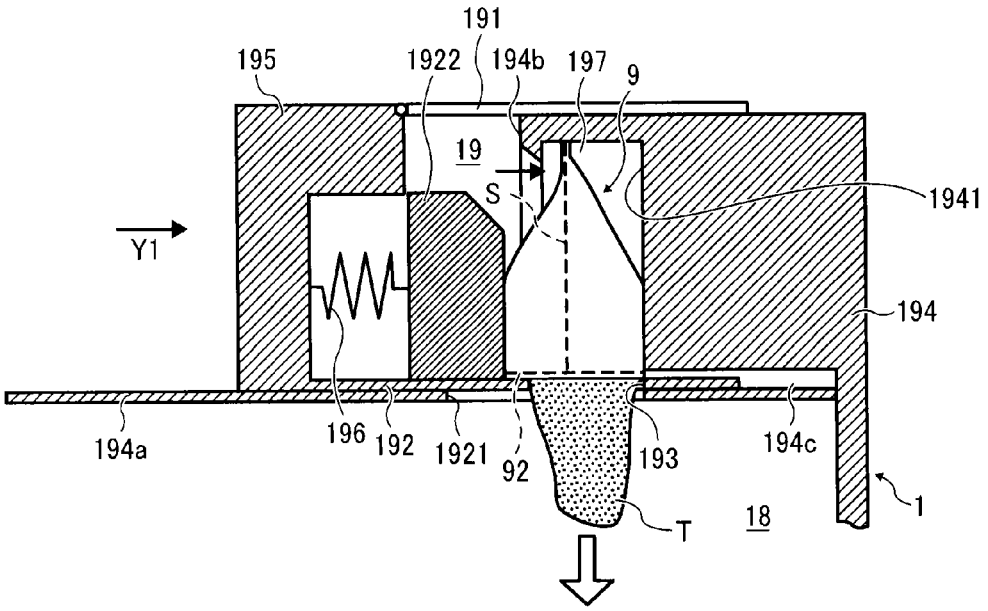
FIG. 7 is a cross-sectional view of the toner container set in the process cartridge shown in FIG. 4, at an early stage of compression, according to the first embodiment.

The movable portion 195 is opposed to the wall 1941 and movable horizontally on the bottom 194*a*. To the movable portion 195, the upper cover 191 is supported openably and closably, and the lower cover 192 extending in the direction (horizontal in FIG. 4) of movement of the movable portion 195 is provided. The lower cover 192 serves as a bottom of the container storage 19. A cover communicating portion 1921 penetrates the lower cover 192. As shown FIG. 4, the cover communicating portion 1921 and the communicating portion 193 are shifted from each other in the direction of movement of the movable portion 195 at the time when the toner cartridge 9 is set (an initial state) before the movable portion 195 moves for the compression. When the movable portion 195 moves and starts compressing the toner cartridge 9 for toner supply, the cover communicating portion 1921 communicates with the communicating portion 193 as shown in FIG. 7. The process cartridge body 194 and the lower cover 192 are sealed with, for example, sponge, to inhibit scattering of toner.

In the movable portion 195, at a position opposed to the wall 1941, the compressing portion 1922 projects toward the wall 1941. The compressing portion 1922 is movable relative to the movable portion 195 and urged by a compressed coil spring 196, serving as a biasing member, toward the wall 1941 from the movable portion 195.

Next, the toner cartridge 9 is described below.

Figure 5:
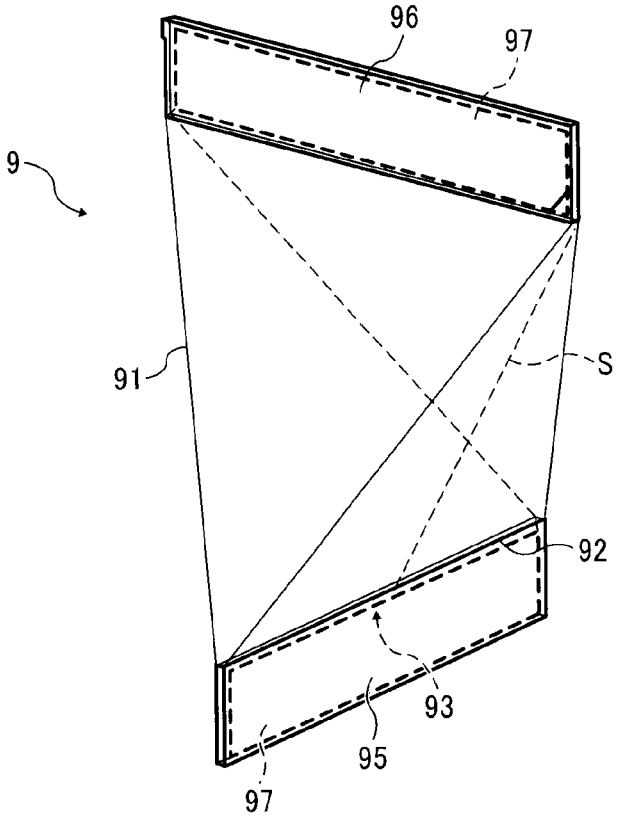
FIG. 5 is a perspective view illustrating a configuration of a toner container according to a first embodiment.

As shown in FIG. 5, in the toner cartridge 9 according to the present embodiment, toner is contained inside a sealed containing portion 91 that is substantially tetrahedral in shape. In the present embodiment, the toner cartridge 9 is assembled to have the substantially tetrahedral containing portion 91 using, for example, a sheet of material such as paper, polyethylene, etc.

Of the six edges of the tetrahedral containing portion 91, a lower edge 92 placed on the lower cover 192 is openable to form an opening 93 for toner supply, via which an interior of the toner cartridge 9 communicates with the outside. The lower edge 92 is sealed with adhesive 97 and designed to open when the toner cartridge 9 is squeezed or compressed with a predetermined amount of force, while interposed between the compressing portion 1922 and the wall 1941. In the present embodiment, the adhesive 97 is, for example, adhesive film CMPS (registered trademark) produced by Mitsui Chemicals Tohcello, Inc. The adhesive 97 (adhesive film CMPS in the present embodiment) serves as a sealing member to seal the opening 93. It is to be noted that, in FIG. 5, reference numerals 95 and 96 represent bonding areas on which the adhesive 97 is provided. After the lower edge 92 (i.e., the opening 93) is opened, the toner cartridge 9 is foldable along a reference fold line S set on medians extending perpendicular from the lower edge 92 of the containing portion 91, respectively, to apexes of triangular faces adjoining each other along the lower edge 92.

It is to be noted that, in the present embodiment, although the toner cartridge 9 is folded flat along the medians that are straight lines extending from the bonding area 96, positioned at the apexes of the triangular faces whose base sides are the lower edge 92, to a center point on the lower edge 92 that is the opposite side of the apexes, the end of the straight line is not limited to the center point on the lower edge 92 but can be shifted along the lower edge 92. In short, the reference fold line S can be any straight line extending from the apexes of the triangular faces to a position on the lower edge 92. Thus, the medians serving as the reference fold line S in the present embodiment have a certain range of placement.

Figure 6:
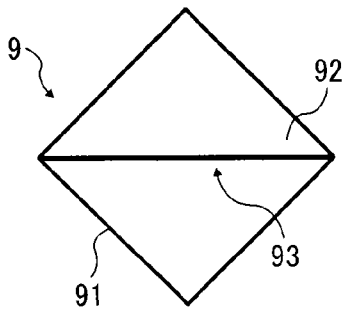
FIG. 6 is a bottom view of the toner container set in the process cartridge in a posture set in the process cartridge shown in FIG. 2.

FIG. 6 illustrates the toner cartridge 9 placed on the lower cover 192 inside the process cartridge 1, as viewed from the side of the toner chamber 18. In this state, the lower edge 92 (opening 93) of the toner cartridge 9 is closed.

Figure 8:
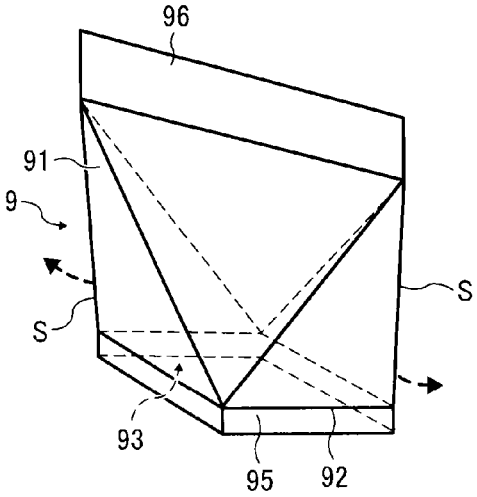
FIG. 8 is a bottom view of the compressed toner container being in a process of toner supply, according to the first embodiment.

To open the opening 93 from this state, as shown in FIG. 7, the movable portion 195 is slid in the compressing direction indicated by arrow Y1, that is, to the right in FIG. 7. Then, the compressing portion 1922 and the wall 1941 come in contact with the toner cartridge 9 from both sides and compress the toner cartridge 9 as the movable portion 195 continues to move. As the toner cartridge 9 is compressed, the sealed lower edge 92 is torn, and the opening 93 is formed as shown in FIG. 8. At that time, the cover communicating portion 1921 and the communicating portion 193, which have been shifted horizontally from each other in the initial state shown in FIG. 4, overlap as the movable portion 195 moves. Accordingly, toner drops from the opening 93 and into the toner chamber 18. Thus, the toner chamber 18 is refilled with toner. Additionally, scattering of toner from the container storage 19 at the time of toner supply can be inhibited since the opening 194*b* is closed by the upper cover 191 and an opening area of the opening 194*b* in the process cartridge body 194 decreases as the movable portion 195 moves.

Figure 10:
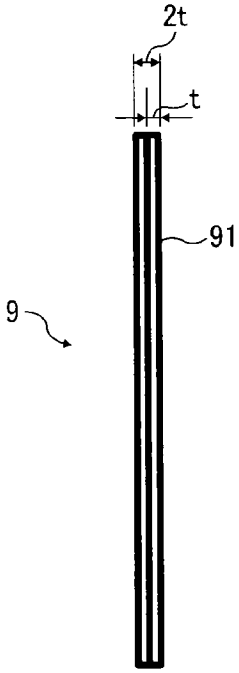
FIG. 10 is an enlarged view of the compressed toner container according to the first embodiment.
Figure 9:
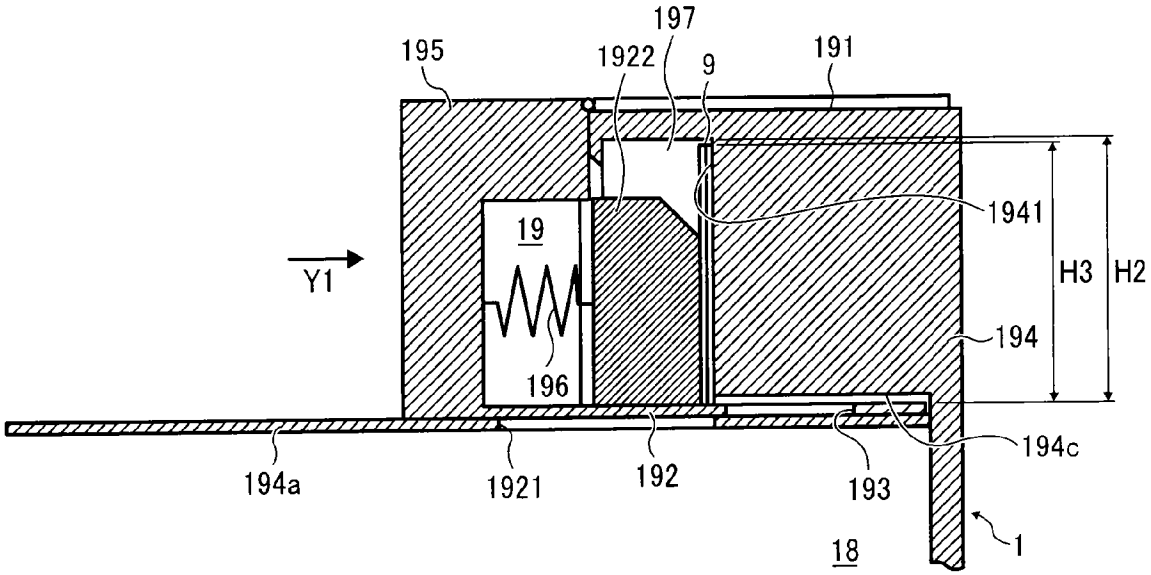
FIG. 9 is a cross-sectional view illustrating the toner container compressed in the process cartridge shown in FIG. 4.

When the movable portion 195 moves further in the compressing direction Y1 from the position shown in FIG. 7, as shown in FIG. 9 (toner supply state), the toner cartridge 9 is pressed by the compressing portion 1922 against the wall 1941 and squeezed inside the compressed container storage 197. The opening 93, which is opened at an initial stage of compression, is closed in a direction perpendicular to the direction of the slit (along the lower edge 92). Accordingly, as shown in FIG. 10, the toner cartridge 9 can be compressed to a thickness 2t that is only twice as thick as the sheet material constituting the toner cartridge 9 and having a thickness t. At the time of compression, the compressed toner cartridge 9 moves since it is on the lower cover 192 united to the movable portion 195 and also pressed by the compressing portion 1922. Accordingly, the compressing portion 1922, the lower cover 192, and the movable portion 195 together constitute a mechanism to move the compressed toner cartridge 9 to the compressed container storage 197.

Figure 11:
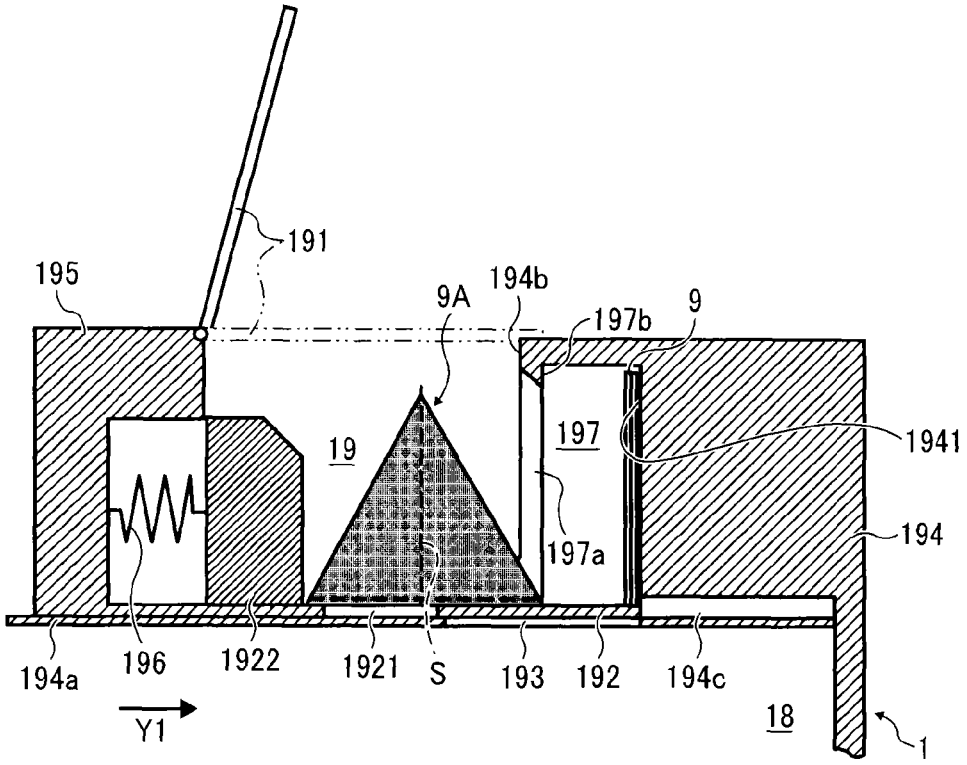
FIG. 11 illustrates the in the process cartridge shown in FIG. 4, in which another toner container is set after the previous one is compressed.

Printing is executed in this state. When the amount of toner remaining in the toner chamber 18 falls below a predetermined amount, the message instructing toner supply appears on the display panel 6. The user lifts and opens the upper cover 191 to a position indicated by solid lines in FIG. 11 and set a new toner cartridge 9 (given reference character "9A" in FIG. 11) on the lower cover 192. At that time, the compressed toner cartridge 9 is in a most compressed state and retained in the compressed container storage 197.

With the compressing portion 1922 and the wall 1941 both serving as compressors to compress the toner cartridge 9, the toner cartridge 9 can be compressed efficiently.

Additionally, the process cartridge 1 includes the compressed container storage 197 to accommodate the compressed toner cartridge 9 and the components to move the compressed toner cartridge 9 to the compressed container storage 197, namely, the movable portion 195, the lower cover 192, and the compressing portion 1922. This configuration can obviate the necessity of discharging the compressed toner cartridge 9 outside the process cartridge 1 or the outside the image forming apparatus 100. Thus, operability can improve.

That is, since the user can be dispensed from removing the used toner cartridge 9 from the container storage 19 each time the new toner cartridge 9 is set, the operability can improve. Additionally, in case that the movable portion 195 moves in the direction opposite the compressing direction Y1, even if the compressed toner cartridge 9 is about to move together with the lower cover 192, the upper portion of the compressed toner cartridge 9 is caught by the upper portion 197*b* of the entrance 197*a*. Accordingly, the toner cartridge 9 can be prevented from falling and does not hinder setting of the new toner cartridge 9.

Additionally, since the toner cartridge 9 according to the present embodiment is foldable along the medians (reference fold line S) of the triangular faces having the lower edge 92 as the base side after the lower edge 92 is opened, the toner cartridge 9 can be compressed flat efficiently to the thickness 2t, which is just twice the thickness t of the sheet material constructing the toner cartridge 9. Therefore, a greater number of toner cartridges 9 can be stored in the container storage 19 (the compressed container storage 197 in particular).

Figure 12A:
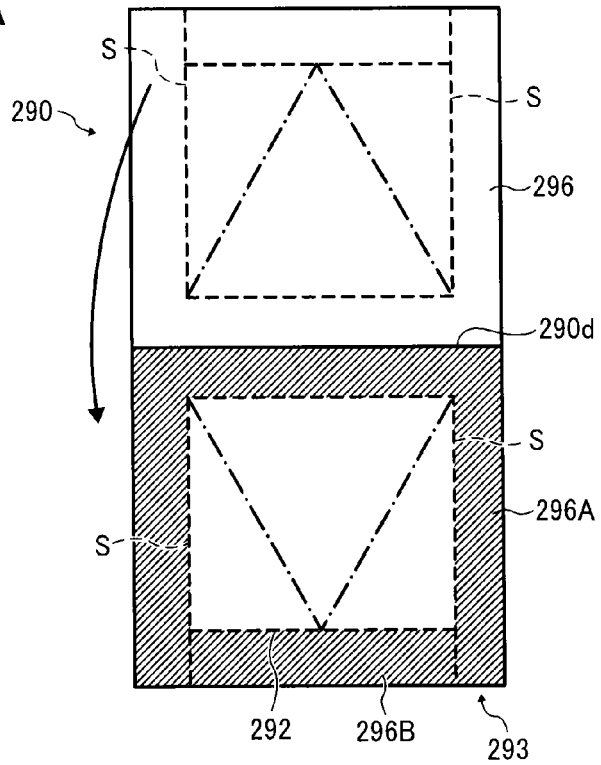
FIG. 12A is a developed view of the toner container according to a second embodiment.
Figure 12B:
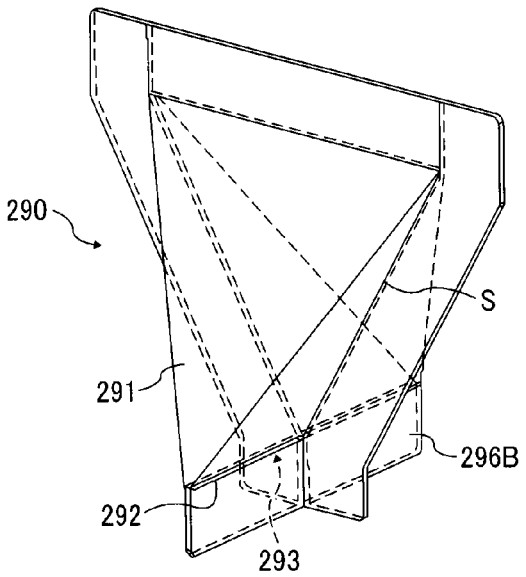
FIG. 12B is a perspective view of an assembled state of the toner container shown in FIG. 12A.

Referring to FIGS. 12A and 12B, a second embodiment of the toner container is described below.

FIG. 12A is a developed view of a toner cartridge 290, and FIG. 12B illustrates an assembled state of the toner cartridge 290 shown in FIG. 12A. The toner cartridge 290 is constructed of a single sheet 296 that is bent along broken lines and alternate long and short dashed lines shown in FIG. 12A and assembled into a substantially tetrahedron. In the configuration shown in FIG. 12A, the sheet 296 is bent in two along a centerline 290*d*, bent in mountain fold along the broken lines, and bent in valley fold along the alternate long and short dashed lines. When the sheet 296 is thus bent, the toner cartridge 290 including a substantially tetrahedral containing portion 291 is assembled as shown in FIG. 12B. In FIG. 12A, areas indicated by hatching represent bonding area 296B adjacent to an openable lower edge 292 and bonding areas 296A adjacent to other edges of the containing portion 291 bonded using, for example, the above-described adhesive film. The second bonding areas 296A are bonded to end portions of the sheet 296 symmetrical to the bonding areas 296A with respect to the centerline 290*d*. The bonding method of the bonding areas 296A can be either identical or different from that of the first bonding area 296A, and, for example, thermal welding may be used. The broken lines extending vertically in FIG. 12A becomes the medians that is, the reference fold line S, when the sheet 296 is assembled. As shown in FIG. 12B, also in the present embodiment, the reference fold line S is set on the medians of the triangular faces having the lower edge 292 as the base side. By providing bent lines preliminarily, the toner cartridge 290 can be folded along the reference fold line S reliably, and the efficiency in compression can improve. Alternatively, the medians may be the border of the bonding area 296A (shown in FIG. 12A), along which the sheet 296 is bonded and jointed.

Figure 14:
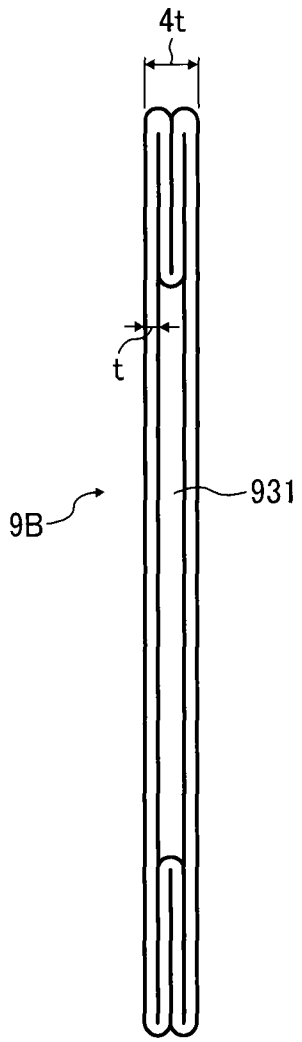
FIG. 14 is an enlarged view of a folded state of a toner container according to a comparative example.

FIG. 14 illustrates, as a comparative example, a toner cartridge 9B that includes a substantially tetrahedral containing portion 931 but is not foldable along the median of the triangular face after the base side of the triangular face is opened. In this example, when compressed, the toner cartridge 9B is folded inside the containing portion 931, and a thickness 4t thereof is multiplied by 4 from the thickness t of the sheet material constructing the toner cartridge 9B.

By contrast, the toner cartridge 290 shown in FIGS. 12A and 12B is foldable along the reference fold line S that is the medians of the triangular faces having the openable lower edge 292 after the lower edge 292 is opened, and the toner cartridge 290 can be compressed to the thickness 2t that is twice the thickness t of the sheet 296 constructing the toner cartridge 290. Accordingly, the container storage 19 (the compressed container storage 197 in particular) can accommodate a greater amount of toner cartridges 290.

A third embodiment of the toner container is described with reference to FIG. 13.

Figure 13:
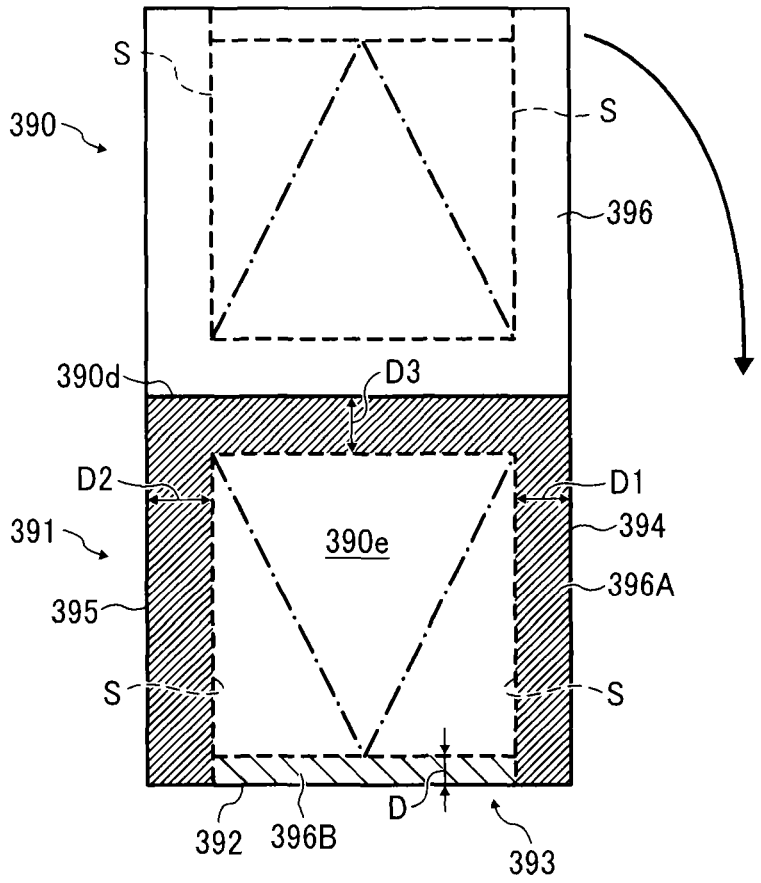
FIG. 13 is a developed view of a toner container according to a third embodiment.

FIG. 13 is a developed view of a toner cartridge 390. The toner cartridge 390 is constructed of a single sheet 396 in which fold lines, indicated by broken lines and alternate long and short dashed lines, are provided symmetrically with respect to a centerline 390*d* to form a substantially tetrahedral shape. The sheet 396 is bent in mountains with the broken lines and in valleys with the alternate long and short dashed lines into the toner cartridge 390 having a substantially tetrahedral containing portion 391. The toner cartridge 390 is foldable along the medians (reference fold line S) of the triangular faces having a lower edge 392 openable to form an opening 393. In the toner cartridge 390, a bonding area 396B adjacent to the opening 393 is smaller in area than that of other bonding areas 396A. The bonding area 396B extends along the lower edge 392 and has a width extending from the lower edge 392 that is opened for toner supply to an inner range 390*e* assembled into the containing portion 391. The bonding areas 396A mean areas respectively extending from ends 394 and 395 of the sheet 396 to the inner range 390*e* (reference fold lines S) and an area extending from the centerline 390*d* to the inner range 390*e*. In the present embodiment, a width D of the bonding area 396B adjacent to the openable lower edge 392 is smaller than widths D1, D2, and D3 of the bonding areas 396A (D<D1, D2, and D3), and thus the bonding area 396B is smaller than the bonding areas 396A. It is to be noted that, although the widths D1, D2, and D3 are identical lengths in FIG. 13, the widths D1, D2, and D3 may be differ from each other.

When the bonding area 396B is smaller in area than the bonding areas 396A, the force of bonding of the bonding area 396B can be weaker than that of bonding areas 396A. Therefore, when the toner cartridge 390 is compressed for toner supply (in the state shown in FIG. 7), only the bonding area 396B (the lower edge 392) can be torn to form the opening 393. It is to be noted that, although the width D of the bonding area 396B is smaller than that of the bonding areas 396A to make the adhesiveness of the bonding area 396B smaller than that of the bonding areas 396A in the description above, alternatively, the type of adhesive or the adhesion method may be different between the bonding areas 396A and 396B.

Although the toner cartridge 9, 9A, 290, and 390 (hereinafter represented by the toner cartridge 9) are set in the process cartridge 1 in the descriptions above, the location where the toner cartridges 9 are set may be different.

Figure 15:
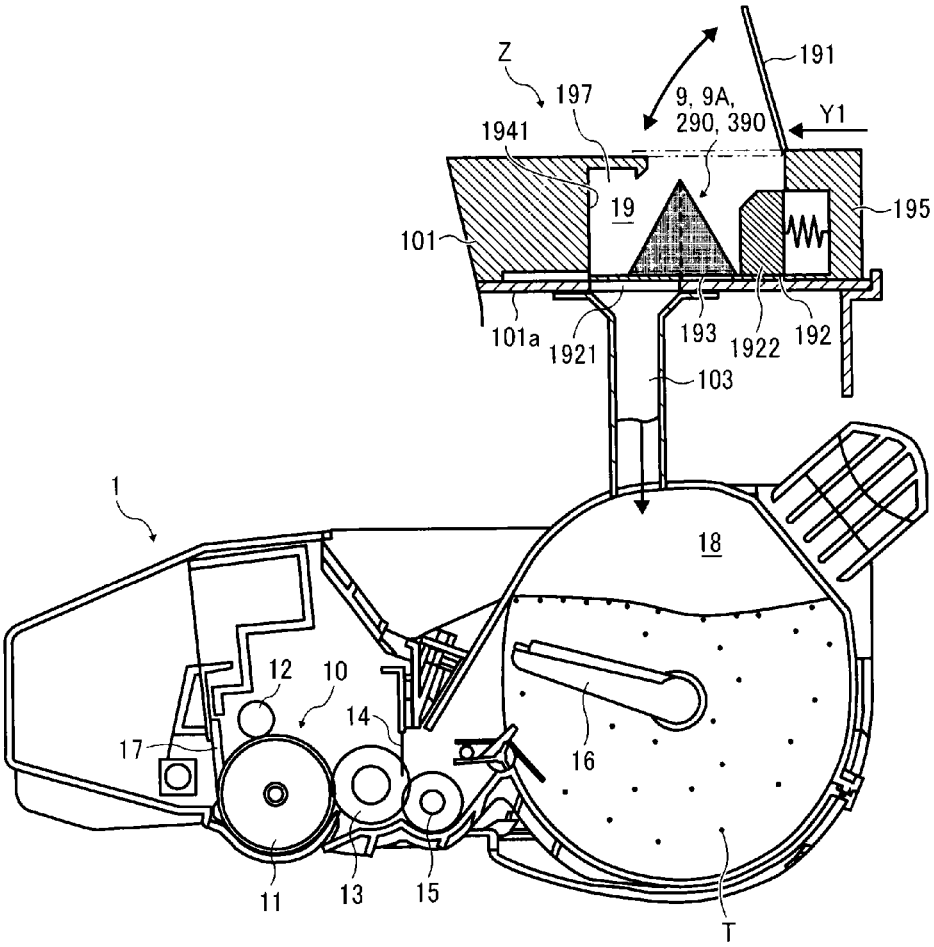
FIG. 15 is the toner container set in an apparatus body of an image forming apparatus shown in FIG. 1.

For example, the toner cartridge 9 may be set in the apparatus body 101 shown in FIG. 15 that includes the container storage 19 in which the toner cartridge 9 is set and a conveyance channel 103 through which toner moves from the container storage 19 to the toner chamber 18 of the process cartridge 1.

In this case, the cover communicating portion 1921 is formed in a bottom 101*a* of the container storage 19 in the apparatus body 101. The apparatus body 101 is provided with a refilling assembly Z including the container storage 19, the compressed container storage 197, the wall 1941, and the movable portion 195 provided with the compressing portion 1922 and the lower cover 192. The toner cartridge 9 is placed on the lower cover 192. In this configuration, as the movable portion 195 moves in the compressing direction Y1, toner is supplied, the toner cartridge 9 is compressed, and the compressed toner cartridge 9 can be stored.

This configuration is advantageous in the term of cost over the configuration in which the refilling assembly Z is provided to the process cartridge 1. The process cartridge 1 is consumable and replaced cyclically. When included in the process cartridge 1, the refilling assembly Z is also replaced as the process cartridge 1 is replaced. Accordingly, the cost of the process cartridge 1 increases, and the cost of the image forming apparatus increases as well.

By contrast, when the apparatus body 101 includes the refilling assembly Z (the container storage 19, the compressed container storage 197, the wall 1941, and the movable portion 195 provided with the compressing portion 1922 and the lower cover 192), the cost of the process cartridge 1 can be reduced, and accordingly the cost of the image forming apparatus can decrease.

Figure 16:
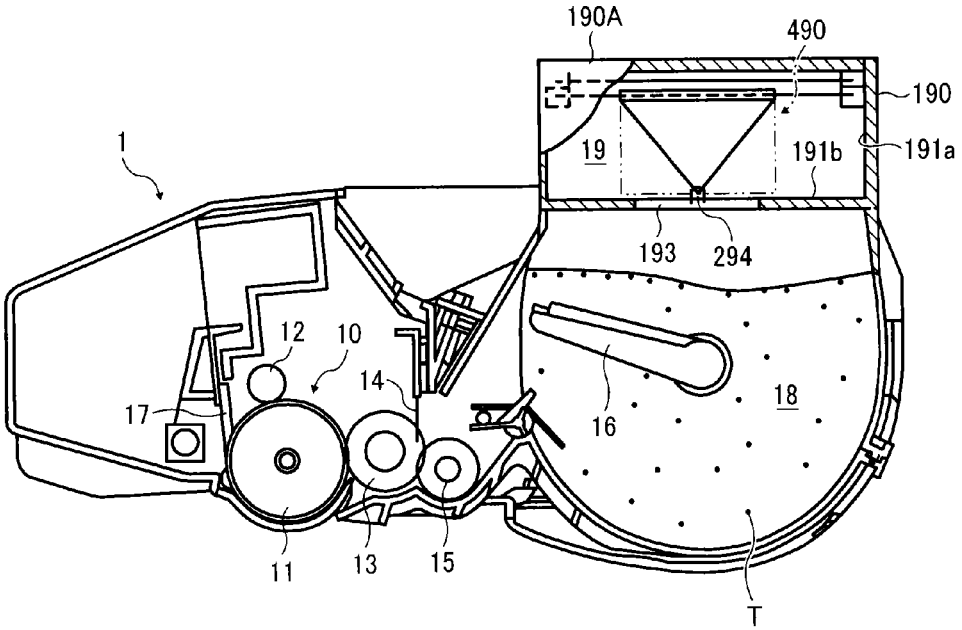
FIG. 16 is a schematic view of a process cartridge according to a fourth embodiment.

Referring to FIG. 16, a process cartridge 1 according to a fourth embodiment is described below.

Similarly to the above-described embodiments, the process cartridge 1 according to the fourth embodiment is removably installable in the apparatus body 101 shown in FIG. 1 and is refilled with toner from a toner cartridge 490 serving as a toner container. Except the difference described below, the process cartridge 1 shown in FIG. 16 is similar to that shown in FIG. 2, and redundant descriptions are omitted.

In the process cartridge 1 according to the fourth embodiment, the container storage 19 is positioned above the toner chamber 18 similarly. The container storage 19 is covered with a casing 190 except a front side. The casing 190 includes an opening 191*a* on the front side. The opening 191*a* is openable and closable by a cover 190A. The toner cartridge 490 is set in from the container storage 19 through the opening 191*a*. In the present embodiment, the cover 190A is supported by the container storage 19 and slidable in a direction perpendicular to the surface of the paper on which FIG. 16 is drawn. A bottom 191*b* of the casing 190 serves as the bottom of the container storage 19 and also as a partition between the container storage 19 and the toner chamber 18. Toner is supplied from the container storage 19 to the toner chamber 18 through a communicating portion 193 formed in the bottom 191*b*. An opener 294 is provided inside the container storage 19 to open the toner cartridge 490 set therein. For example, the opener 294 can be a cutter. To set the toner cartridge 490 in the container storage 19, the cover 190A is pulled out in the direction perpendicular to the surface of the paper on which FIG. 16 is drawn, thereby opening the opening 191*a* through which the toner cartridge 490 is put therein.

When the message instructing toner supply appears on the display panel 6 shown in FIG. 1, the user pulls out the cover 190A and can set the toner cartridge 490 in the container storage 19.

Next, the toner cartridge 490 is described below with reference to FIGS. 17A through 19A.

Figure 17A:
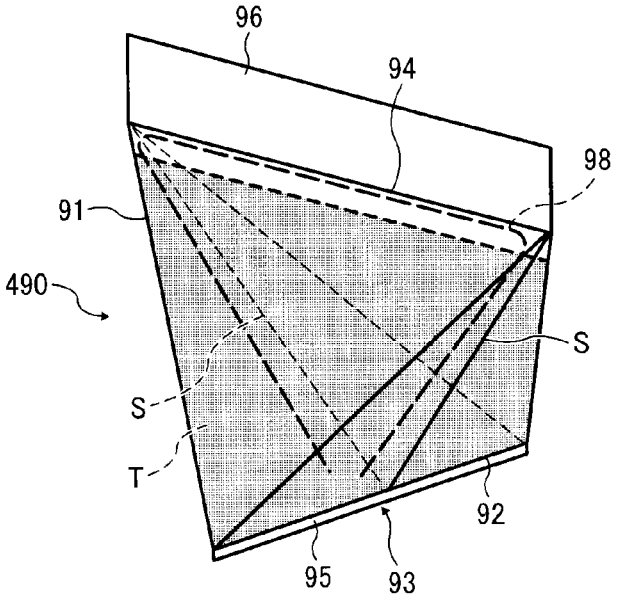
FIG. 17A is a perspective view of a toner container according to the fourth embodiment.
Figure 17B:
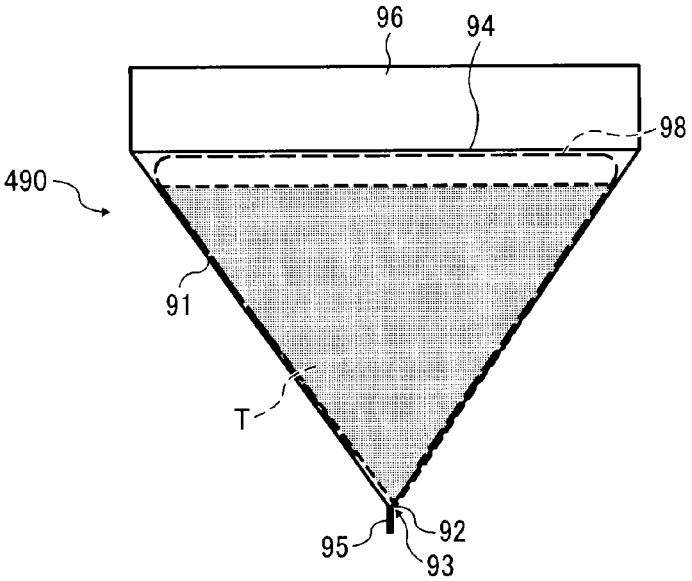
FIG. 17B is a side view of the toner container shown in FIG. 17A, as viewed in a direction of movement.

FIGS. 17A and 17B illustrate a configuration of the toner cartridge 490. FIGS. 18A through 18D illustrate processes to open the toner cartridge 490 and schematic shapes of the toner cartridge 490 in the processes.

As shown in FIGS. 17A and 17B, similarly to the above-described embodiments, the toner cartridge 490 includes the foldable, polyhedral containing portion 91, and the lower edge 92 of the containing portion 91 is openable. When the lower edge 92 is opened, the opening 93 that communicates with the outside appears. The opening 93 serves as a toner outlet through which toner is discharged from the toner cartridge 490. In the configuration shown the drawings, the containing portion 91 is substantially tetrahedral, contains toner, and sealed. In the present embodiment, a single flexible sheet material constructed of, for example, paper, polyethylene, and the like, is assembled into the toner cartridge 490 having the substantially tetrahedral containing portion 91. The sheet material is bonded in bonding areas 95 and 96 respectively adjacent to the lower edge 92 and an upper edge 94 of the containing portion 91. The upper bonding area 96 is greater in width (short side length of the bonding area) than the bonding area 95 and serves as a support portion supported by a container supporter described later. When not used as the support portion, the bonding area 96 may have a smaller width sufficient to maintain adhesiveness.

The containing portion 91 is provided with the reference fold line S along which the toner container 490 is folded flat, and an elastic member 98 is provided along the reference fold line S inside the containing portion 91. The elastic member 98 is elastically deformed restorably to an original state. For example, the elastic member 98 can be a thin leaf spring constructed of a shape memory material in which a linear shape before deformation is recorded. The thin leaf spring can be attached, may be bonded using adhesive, to inner faces of the containing portion 91 to conform to the upper edge 94 and the reference fold lines S on the triangular faces of the containing portion 91, on both sides of the openable lower edge 92. Accordingly, when the bonding areas 95 and 96 are bonded and the containing portion 91 is sealed, the elastic member 98 in the containing portion 91 is elastically deformed into an O-shape substantially.

The resilience of the elastic member 98 is restrained by the thickness of the sheet material constructing the containing portion 91 and the adhesiveness of the bonding areas 95 and 96. Alternatively, the elastic member 98 can be constructed of a thin rod-shaped material that can be bent. The material may be resin, metal, or the like. It is preferable that the elastic member 98 is thin or narrow and has a thickness of 1 mm or smaller so that the elastic member 98 in a bent state is less bulky. Thus, the elastic member 98 is kept inside the containing portion 91 in a bent state following the upper edge 94 and the medians of two triangular faces adjoining each other along the lower edge 92, which is a posture of the elastic member when the toner cartridge 490 set in the container storage 19. The elastic member 98 can be kept at a given position inside the containing portion 91 with sealing force exerted by the bonding area 95 adjacent to the lower edge 92 of the containing portion 91. In the toner cartridge 490, the lower edge 92 and the upper edge 94 are perpendicular to each other and skew lines, that is, in the relation of torsion.

Figure 18A:
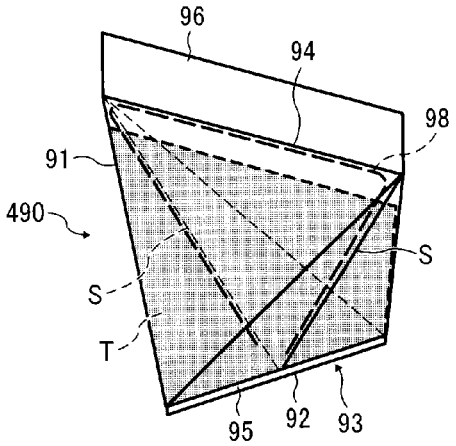
FIGS. 18A through 18D illustrate schematic shapes of the toner container shown in FIG. 17A at respective stages of opening and compression.
Figure 18B:
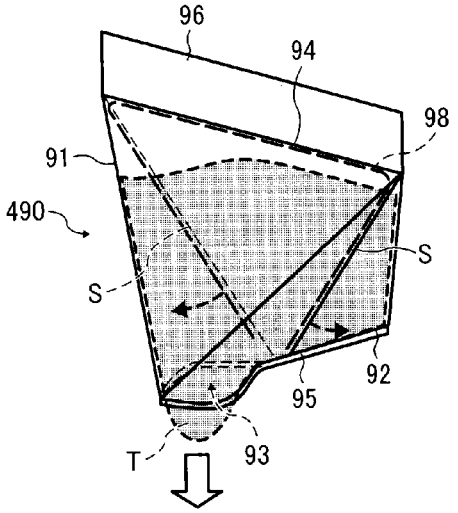
Figure 18C:
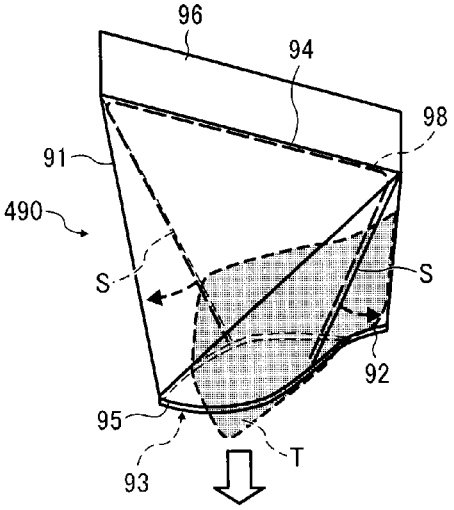
Figure 18D:
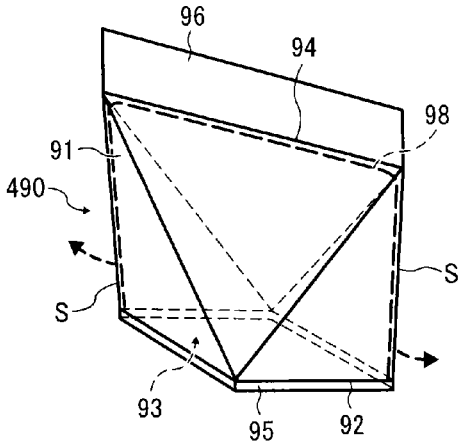

As described above, the toner cartridge 490 includes the substantially tetrahedral containing portion 91 that is deformable and foldable along the reference fold lines S, and the elastic member 98 is provided inside the toner cartridge 490 and elastically and restorably deformed to follow the reference fold lines S and the upper edge 94. Accordingly, when the toner cartridge 490 is set in the container storage 19 as shown in FIG. 18A, the lower edge 92 of the containing portion 91 is gradually torn by the opener 294 (shown in FIG. 16) as shown in FIG. 18B and to the state shown in FIG. 18C. Then, the force that keeps the elastic member 98 substantially O-shaped becomes weaker, and the elastic member 98 opens from the O-shape to a U-shape due to the resilience. With the change (restoration) in shape of the elastic member 98, biasing force (resilience) in the direction to open the containing portion 91 from inside to the outside acts on the reference fold lines S, and the containing portion 91 deforms into a flat shape as shown in FIG. 18D. This configuration can secure opening of the lower edge 92 (into the opening 93) and folding of the toner cartridge 490. Accordingly, efficiency in compressing the toner cartridge 490 can improve and facilitate storage of the used toner cartridge 490. Thus, a greater number of the used toner cartridges 490 can be accommodated. Additionally, since the lower edge 92 is gradually torn by the opener 294, forming the opening 93, the deformation of the containing portion 91 can promote discharge of toner that falls under its own weight, thus reducing the amount of toner remaining in the containing portion 91. When the opening of the toner cartridge 490 completes, the discharge of toner can completes simultaneously.

Since the lower edge 92 and the upper edge 94 are skew lines (in the relation of torsion) to each other, the toner cartridge 490 can contact a shaft 200 (shown in FIG. 21A) in a larger area and attached thereto stably. Further, since the toner cartridge 490 is in a posture tapered downward, toner can fall easily.

In the present embodiment, the reference fold lines S are provided on the medians of the triangular faces whose base sides are the opened lower edge 92 of the containing portion 91. Providing the reference fold lines S on the medians can facilitate folding of the toner cartridge 490 and accordingly storage of the used toner cartridges 490. Thus, a greater number of the used toner cartridges 490 can be accommodated.

Figure 19A:
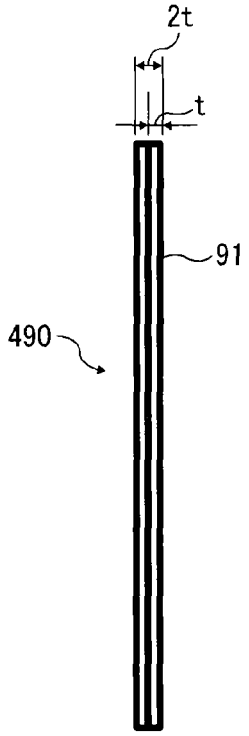
FIG. 19A illustrates a compressed state of the toner container shown in FIG. 17A for understanding of thickness thereof.

Additionally, the reference fold lines S being mountain fold lines to project to the outer sides of the containing portion 91 ensures that the reference fold line S opens outward, when the lower edge 92 is opened and the elastic member 98 exerts the biasing force to open the containing portion 91 from inside. Accordingly, the containing portion 91 can become flat and the thickness thereof can be smaller compared with the case in which the reference fold line S is folded inward. That is, when the toner cartridge 490 is thus folded flat, as shown in FIG. 19A, the toner cartridge 490 can have the thickness 2t that is twice the thickness t of the sheet material.

Figure 19B:
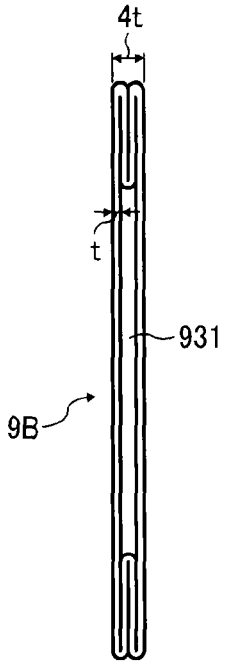
FIG. 19B is a compressed state of a comparative toner container.

By contrast, FIG. 19B illustrates a toner cartridge 9B according to a comparative example having a containing portion 931 bent inside along the reference fold line S. As shown in FIG. 19B, the folded containing portion 931 has a thickness 4t that is quadrupled from the thickness t of the sheet material.

Therefore, according to the present embodiment, the folded toner cartridge 490 can be compact and stored easily, and a greater number of the toner cartridges 490 can be accommodated.

Since the containing portion 91 is flexible, it is possible that, even when toner is contained in the containing portion 91, the tetrahedral shape (outer shape) is deformed by toner pushing from inside upon vibration during transport or force from outside the toner cartridge 490 depending of the thickness of the sheet material. When the outer shape is impaired, not only degradation in the appearance but also a risk of damage arises. Further, deformation may make it difficult to hold the toner cartridge 490 being set in the container storage 19. In view of the foregoing, in the present embodiment, the bonding areas 95 and 96 are increased in width and used as the support portions to keep an angle between the adjacent two triangular faces of the tetrahedral containing portion 91.

When the containing portion 91 is provided with the support portions (the bonding areas 95 and 96), the outer shape of the toner cartridge 490, which is deformable, can be maintained before use (during transport). Accordingly, unintended changes in shape, damage to the toner cartridge 490, and difficulties in holding the toner cartridge 490 can be inhibited.

Although the support portions are the bonding areas 95 and 96 respectively adjacent to the lower edge 92 and the upper edge 94 in the present embodiment, the configuration of the support portions are not limited thereto.

Figure 20A:
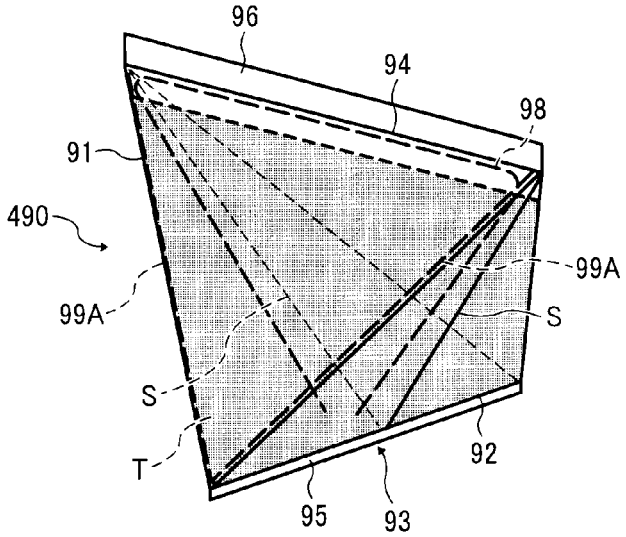
FIGS. 20A and 20B illustrates variations of the toner container according to the fourth embodiment.

For example, as shown in FIG. 20A, a support portion 99A to support that edge may be provided inside at least one of the edges of the tetrahedral containing portion 91. In the configuration shown in FIG. 20A, the two of the edges are provided with the support portions 99A, respectively.

Figure 20B:
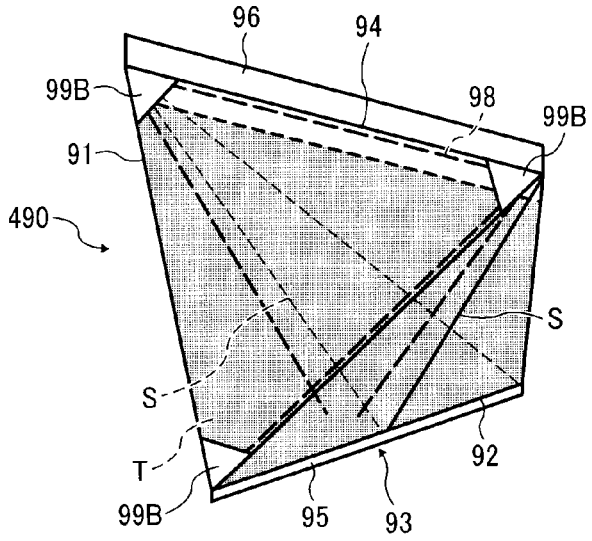

Alternatively, referring to FIG. 20B, the support portion may be triangular and planar and provided to at least one of the apexes of the containing portion 91. The planar support portion may be provided to an inner side, an outer side, or both sides of the containing portion 91. In the configuration shown in FIG. 20B, three planar support portions 99B are respectively provided to three apexes, on the outer side of the containing portion 91. Instead of providing the planar support portions 99B, the sheet material constituting the tetrahedral containing portion 91 may include the support portions. Specifically, the sheet material may be thickened in portions adjacent to the two upper apexes of the containing portion 91 from other portions to give retentivity, meaning the propensity to retain a particular shape, or make the containing portion 91 taut to keep the outer shape.

Similarly to the bonding areas 95 and 96 serving as the support portions, with the support portions 99A or 99B, the outer shape of the toner cartridge 490, which is deformable, can be maintained before use (during transport). Accordingly, unintended changes in shape or damage to the toner cartridge 490 can be inhibited.

Next, descriptions are given below of the container storage 19 and adjacent portions with reference to FIGS. 21A through 21D.

In the present embodiment, the container storage 19 in which the toner cartridge 490 is set is provided in the process cartridge 1. In that sense, the body to which the container storage 19 is provided means the process cartridge 1. However, as described with reference to FIG. 15, the container storage 19 may be provided in not the process cartridge 1 but the apparatus body 101. In this configuration, the container storage 19 is connected via the conveyance channel 103 (shown in FIG. 15) to the toner chamber 18 in the process cartridge 1 to supply the toner discharged from the toner cartridge 490 in the container storage 19 to the toner chamber 18 through the conveyance channel 103.

Figure 21A:
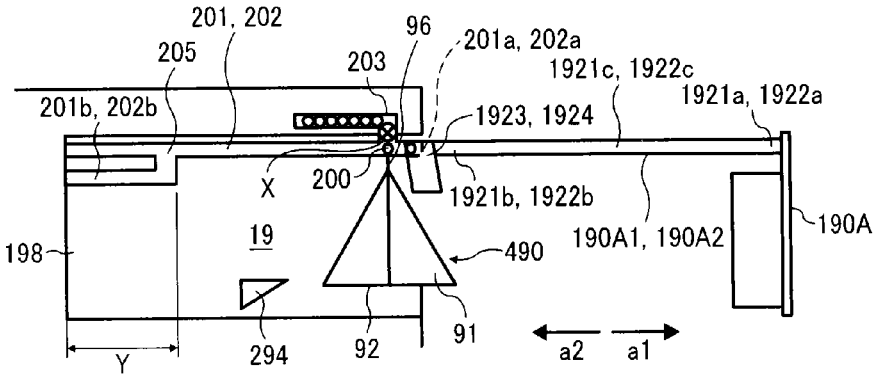
FIG. 21A is a cross-sectional view of a container storage and adjacent areas according to the fourth embodiment.

FIG. 21A through FIG. 21D illustrate configurations and actions of the container storage 19 in which the toner cartridge 490 is set and adjacent areas. As shown in FIG. 21A, the container storage 19 includes the shaft 200, serving as the container supporter, to support the bonding area 96, serving as the support portion, of the toner cartridge 490.

Figure 21B:
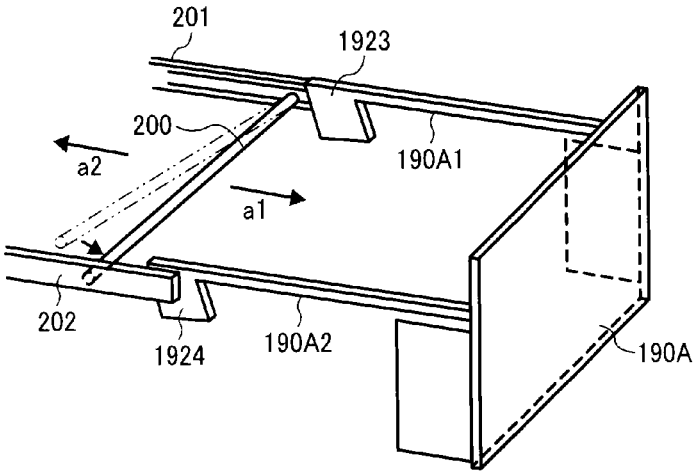
FIGS. 21B through 21D are perspective views illustrating actions of the container storage shown in FIG. 21A, relating to setting of the toner container.

As shown in FIG. 21B, support arms 190A1 and 190A2 are provided to both sides (on front and back sides of the paper on which FIG. 21A is drawn) of the cover 190A and extend in the direction indicated by arrows a1 and a2 in which the cover 190A moves. The support arms 190A1 and 190A2 are supported by rails 201 and 202 provided to the container storage 19 slidably in the lateral direction in FIG. 21A as indicated by arrows a1 and a2. The cover 190A moves away from the container storage 19 in the direction indicated by arrow a1 (hereinafter "direction a1") and retracted toward the container storage 19 in the direction indicated by arrow a2 (hereinafter "retracting direction a2").

The cover 190A is attached to first ends 1921*a* and 1922*a* of the support arms 190A1 and 190A2. Second ends 1921*b* and 1922*b* of the support arms 190A1 and 190A2 are respectively provided with contact portions 1923 and 1924 serving as a conveyance member to transport the shaft 200 in the retracting direction a2. Both ends of the shaft 200 are supported by the rails 201 and 202. The contact portions 1923 and 1924 extend down beyond the rails 201 and 202 and disposed to face the shaft 200 supported by the rails 201 and 202. With this configuration, when the cover 190A moves in the retracting direction a2, the shaft 200 is pushed by the contact portions 1923 and 1924 and moves inside the rails 201 and 202. In other words, the apparatus body 101 or the process cartridge 1 includes the conveyance member to move the shaft 200 in conjunction with opening and closing of the cover 190A.

The rails 201 and 202 are bilaterally symmetric. The rails 201 and 202 extend from the opening 191*a* of the container storage 19 in the retracting direction a2 to a distal side of the container storage 19. First ends 201*a* and 202*a* of the rails 201 and 202 positioned at the opening 191*a* (on a proximal side of the container storage 19) communicate with rails 203 to accommodate multiple shafts 200. The rails 203 are identical or similar in shape and disposed above the rails 201 and 202, respectively. Each rail 203 includes a connecting portion X connected to the first end 201*a* or 202*a*. The connecting portion X is position on the distal side (downstream in the retracting direction a2) from the contact portions 1923 and 1924 when the cover 190A is fully pulled out to the position shown in FIG. 21A. Additionally, the connecting portions X are above upper faces 1921*c* and 1922*c* of the support arms 190A1 and 190A2.

The rails 201 and 202 have a width supportable only a single shaft 200. Accordingly, when the contact portions 1923 and 1924 are positioned on the proximal side (upstream in the retracting direction a2) from the connecting portions X, the shaft 200 whose ends are supported and contained in the rails 203 falls under its own weight from the rails 203 into the rails 201 and 202. When the cover 190A is moving in the retracting direction a2, the connecting portions X are closed by the upper faces 1921*c* and 1922*c* of the support arms 190A1 and 190A2, and the shaft 200 is prevented from falling into the rails 201 and 202.

The number of the shafts 200 accommodated in the rails 203 is equal to or smaller than the number of the toner cartridges 490 used to supply an amount of toner corresponding to a number of sheets printable at a maximum (i.e., limit of the number of printable sheet) that means a usage limit of the apparatus. For example, when the process cartridge 1 is printable up to 50000 sheets, and the quantity of toner supplied by a single toner cartridge 490 corresponds to 5000 sheets, ten shafts 200 are preliminarily set in the process cartridge 1 at a maximum.

The toner cartridge 490 is suspended and supported by the shaft 200. Supported by the shaft 200, the toner cartridge 490 can be stable in posture and reliably opened by the opener 294.

When the container storage 19 is provided with the multiple shafts 200, it is not necessary to remove the used toner cartridge 490 from the shaft 200, and another toner cartridge 490 can be attached to another shaft 200. Additionally, when the number of the shafts 200 is not greater than the number of the toner cartridges 490 corresponding to the limit of the number of sheets printable, the toner cartridge 490 is not set in the container storage 19 after the number of sheets printed exceeds the limit. Accordingly, image formation after replacement timing can be prevented, thereby preventing production of substandard images. Therefore, a desired image quality can be secured.

From intermediate positions of the rails 201 and 202, bifurcating portions 205 extend to second end portions 201*b* and 202*b* on the distal side (the downstream side in the retracting direction a2). The bifurcating portion 205 is stepped down and the second end portions 201*b* and 202*b* are positioned lower than the first ends 201*a* and 202*a*. In the present embodiment, the container storage 19 includes a storage compartment 198 positioned downstream from the bifurcating portion 205 in the retracting direction a2 to store the toner cartridge 490 after opened by the opener 294. A depth Y (shown in FIG. 21A), which is a dimension in the retracting direction a2, of the storage compartment 198 is designed to accommodate the number of the toner cartridges 490 preliminarily set in the container storage 19.

Inside the container storage 19, the opener 294 is disposed on the proximal side (downstream in the direction a1) from the storage compartment 198 and in a lower portion of the container storage 19. The opener 294 is disposed to face the lower edge 92 of the toner cartridge 490 set in the container storage 19. The opener 294 is disposed to tear the lower edge 92, or a portion adjacent thereto, and open the containing portion 91, forming the opening 93, as the toner cartridge 490 moves in the retracting direction a2.

Descriptions are given below of actions from setting of the toner cartridge 490 in the above-described configuration to replacement thereof.

As shown in FIG. 21A, in a state in which the cover 190A is pulled out in the direction a1 at a maximum, the user attaches the bonding area 96 of the toner cartridge 490 to the shaft 200 with the lower edge 92 on the bottom. Thus, the toner cartridge 490 is suspended on the shaft 200. In the present embodiment, for example, the bonding area 96 is wrapped around an outer circumference of the shaft 200.

It is to be noted that the container supporter is not limited to the shaft 200 that is a simple shaft.

Figure 21C:
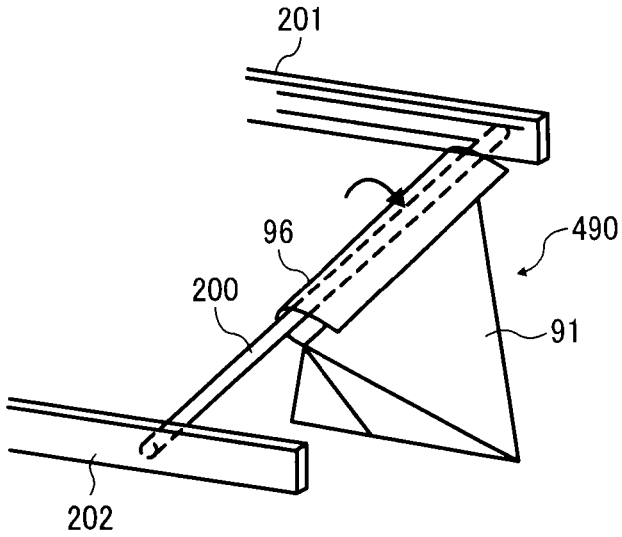
Figure 21D:
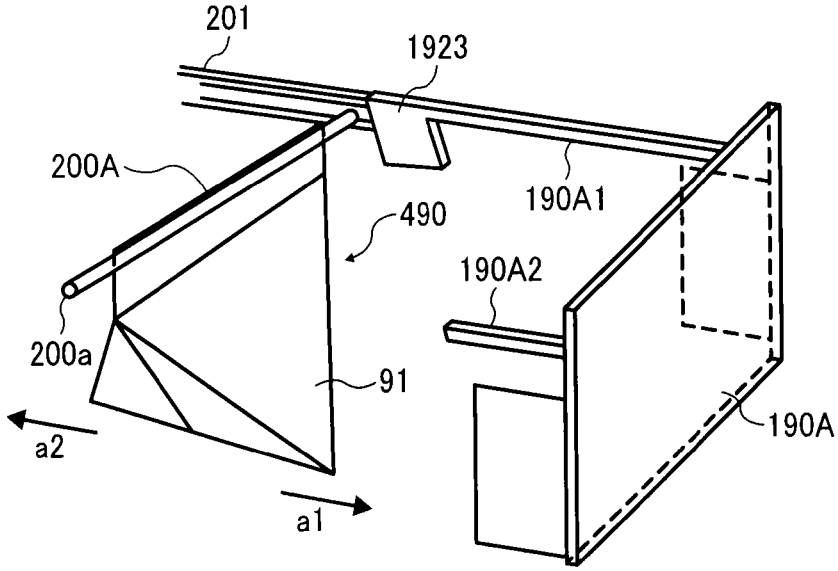

For example, as shown in FIG. 21D, the container supporter may be a shaft 200A provided with a slit 200*a* extending from a first end in an axial direction of the shaft 200A. In this configuration, the bonding area 96 on the upper side of the toner cartridge 490 is inserted into the slit 200*a* and retained therein. In this case, in a state in which a second end of the shaft 200A is inserted in the rail 201, the first end of the shaft 200A is disengaged from the rail 202 (shown in FIG. 21A), and the bonding area 96 is inserted in the slit 200*a*, after which the first end of the shaft 200A is inserted in the rail 202. With this configuration, after the toner cartridge 490 is set, the shaft 200A can be movably supported by the rails 201 and 202. Alternatively, the toner cartridge 490 may be set as follows. Remove the shaft 200A from the rails 201 and 202, insert the bonding area 96 in the slit 200*a*, and attach the shaft 200A to the rails 201 and 202.

Figure 22A:
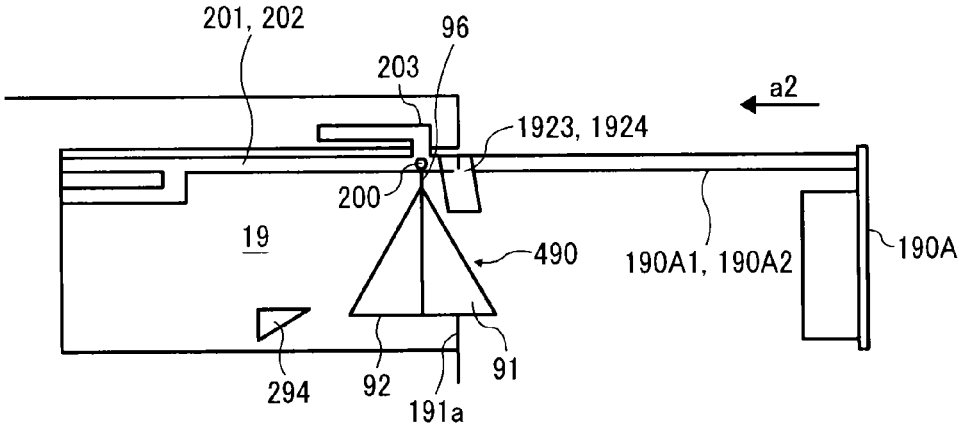
FIGS. 22A through 22D illustrate processes from setting to opening of the toner container according to the fourth embodiment.
Figure 22B:
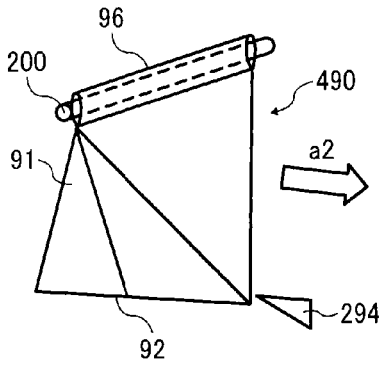
Figure 22C:
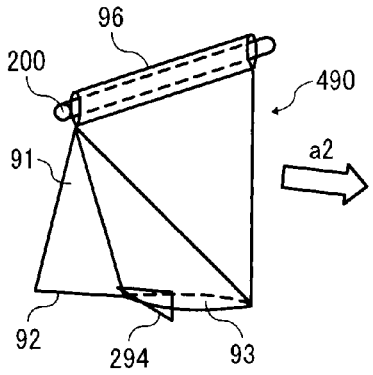

After the toner cartridge 490 is attached to the shaft 200, the user moves the cover 190A in the retracting direction a2 as shown in FIG. 22A and closes the opening 191*a*. In conjunction with the closing action, the toner cartridge 490 supported by the shaft 200 moves from the opening 191*a* to the distal side inside the container storage 19. While the toner cartridge 490 thus moves, the lower edge 92 (or the adjacent area) of the toner cartridge 490 is pressed against the opener 294 as shown in FIG. 22B and torn by the opener 294 as shown in FIG. 22C. Then, toner is discharged from the containing portion 91 under its own weight.

Figure 22D:
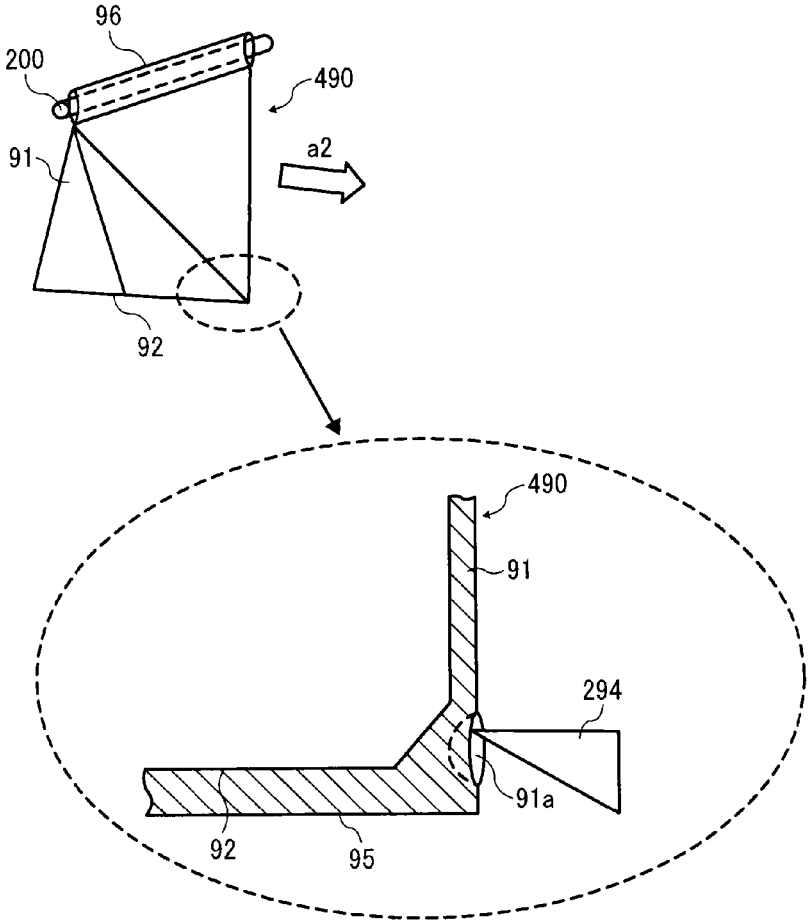

To make sure to tear the toner cartridge 490, it is preferable that the toner cartridge 490 includes a guide or lead-in portion (enclosed by broken oval in FIG. 22D) to guide the opener 294. The guide is provided to a portion where the opener 294 bites in the toner cartridge 490 firstly. Referring to FIG. 22D, for example, a pouched or pocket-like guide portion 91*a* may be provided to that portion so that an end of the opener 294 is inserted therein. In other words, the toner cartridge 490 may include a portion (the guide portion 91*a*) to introduce the opener 294 therein when the opener 294 tears the toner cartridge 490.

Providing the opener 294 inside the container storage 19 is advantageous in that the user's action to open the toner cartridge 490 can be dispensed. Accordingly, conveniences of the user improve, and scattering of toner can be inhibited when the toner cartridge 490 is opened.

If opening of the toner cartridge 490 is started in a state in which the cover 190A is opened largely and the toner cartridge 490 is exposed from the container storage 19 (the apparatus body 101 or the process cartridge 1), it is possible that powdered toner, emerging like smoke, leaks out from the container storage 19 (the apparatus body 101 or the process cartridge 1) as the toner cartridge 490 is opened and toner is discharged therefrom.

However, in the present embodiment, the opener 294 starts opening the toner cartridge 490 from the state in which the toner cartridge 490 is entirely disposed inside the container storage 19. This configuration can substantially reduce the possibility that powdered toner, which emerges like smoke from the opened toner cartridge 490, leaks outside the apparatus. Additionally, in the present embodiment, when the toner cartridge 490 is pushed in the retracting direction a2, the lower edge 92 of the containing portion 91 is opened from the distal side. This is advantageous in inhibiting toner from moving toward the cover 190A (the proximal side).

With the shaft 200 that moves in conjunction with opening and closing of the cover 190A, work of the user to set another toner cartridge 490 can be reduced, thus improving the operability.

Figure 23A:
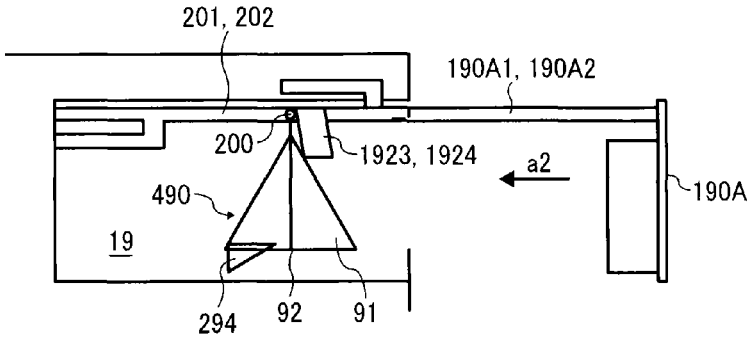
FIGS. 23A through 23D illustrate the toner container moving inside the container storage shown in FIG. 21A.

Referring to FIG. 23A, as the opener 294 starts opening the toner cartridge 490, the toner inside the toner cartridge 490 falls to the toner chamber 18 (shown in FIG. 16), agitated, and transported to the supply roller 15. It is preferred that the amount of toner contained inside the toner cartridge 490 be smaller than a capacity of the toner chamber 18 to inhibit clogging in the container storage 19 and overflow of toner.

Figure 23B:
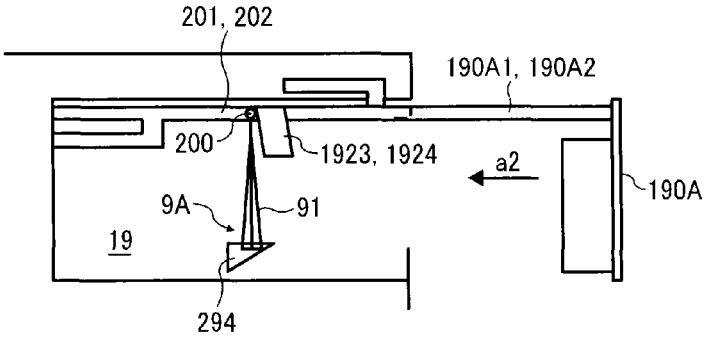
Figure 23C:
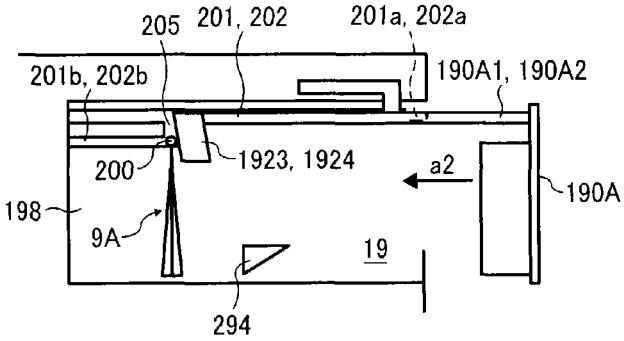
Figure 23D:
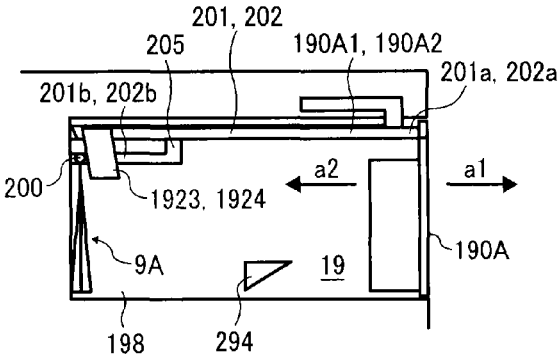

As shown in FIGS. 18D and 23B, after toner is discharged therefrom, the used toner cartridge 490 is deformed and folded flat and moved in the retracting direction a2 as the cover 190A moves in the retracting direction a2. In FIGS. 23B through 23D, reference character 9A represents the used toner cartridge 490 in a folded state. Reaching the bifurcating portion 205, as shown in FIG. 23C, the shaft 200 falls and is guided to the second end portions 201*b* and 202*b* lower than the first ends 201*a* and 202*a* of the rails 201 and 202. As the cover 190A moves in the retracting direction a2 in this state, as shown in FIG. 23D, the contact portions 1923 and 1924 push the shaft 200 supporting the folded toner cartridge 490 in the retracting direction a2. Then, the folded toner cartridge 9A moves inside the storage compartment 198.

In this configuration, the rails 201 and 202 is used for both of holding the shaft 200 that supports the cover 190A and movably supporting the contact portions 1923 and 1924 to push the shaft 200. Accordingly, the two functions can be geared to each other by moving the cover 190A.

Since the contact portions 1923 and 1924 contact and transport the toner cartridge 490 in the retracting direction a2, the efficiency can be enhanced in both of the transport of the toner cartridge 490 and the storage thereof. That is, bulkiness of the folded, used toner cartridge 9A can be reduced, thus further increasing the compression efficiency, and a greater number of the used toner cartridges 9A can be stored. Additionally, when each of the contact portions 1923 and 1924 is disposed to partly contact the reference fold line of the used toner cartridge 9A, the contact portions 1923 and 1924 can push the used toner cartridge 9A to the distal side of the storage compartment 198 while compressing it.

Since the contact portions 1923 and 1924 to move the used toner cartridge 9A to the storage compartment 198 are provided, the used toner cartridge 9A can be stored in the preferred portion, that is, the storage compartment 198. Further, since the contact portions 1923 and 1924 move in conjunction with the movement of the cover 190A, closing the cover 190A and storing the used toner cartridge 9A can be performed at a time. Thus, this configuration can streamline actions performed by the user to close the cover 190A and move the used toner cartridge 9A, thereby improving the convenience and operability.

An amount of toner storable from the toner chamber 18 to the supply roller 15 is greater than the toner containing capacity of the toner cartridge 490. Additionally, the process cartridge 1 or the apparatus body 101 is provided with a detector to detect the amount of toner present from the toner chamber 18 to the supply roller 15 (inside a toner conveyance channel). The detector can be an optical sensor, a torque sensor provided to a shaft of the agitator 16, or the like. In the case of the optical sensor, a detection window is disposed to pass the toner conveyance channel, and the optical sensor outputs an error signal when toner decreases and light is not blocked. In this case, for example, when the number of times the error signal is output reaches "N" while the photoreceptor 11 rotates a predetermined distance, the controller determines that the toner conveyance channel is in a state of "toner end" and reports it on the display panel 6 shown in FIG. 1.

In the case of the torque sensor, for example, when the torque of rotation of the agitator 16 becomes lower than a predetermined value as the amount of toner decreases, the controller determines that the toner conveyance channel is in a state near "toner end" and reports it on the display panel 6 shown in FIG. 1. After a predetermined number of sheets are printed from then, "toner end" can be reported on the display panel 6.

Figure 24A:
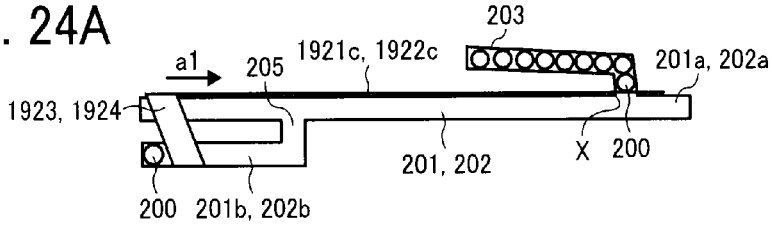
FIGS. 24A through 24F illustrate actions of the container storage shown in FIG. 21A, relating to setting of another toner container.
Figure 24B:
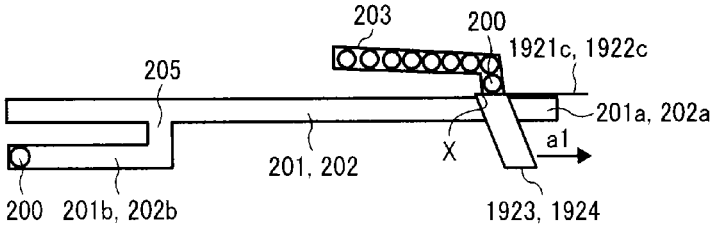
Figure 24C:
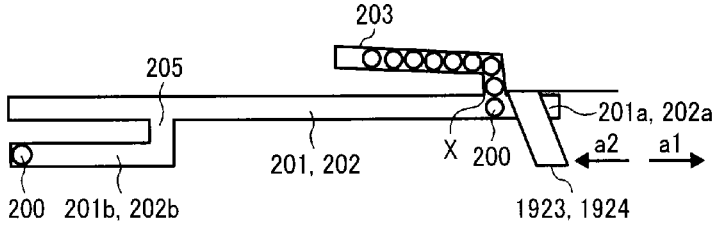

When the state of "toner end" is reported, to set another toner cartridge 490, the user pulls out the cover 190A in the direction a1 from the state shown in FIG. 23D, in which the contact portions 1923 and 1924 are at the positions shown in FIG. 24A. The user pulls out the cover 190A so that the contact portions 1923 and 1924 reach the connecting portions X as shown in FIG. 24B and pass by the connecting portions X as shown in FIG. 24C. In this state, the cover 190A is fully opened. When the contact portions 1923 and 1924 pass by and are positioned downstream from the connecting portions X in the direction a1, the connecting portion X are opened, and only one of the shafts 200 stored in the rails 203 falls under its own weight to the rails 201 and 202.

Figure 24D:
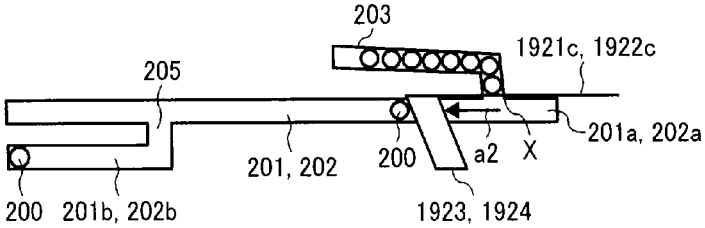
Figure 24E:
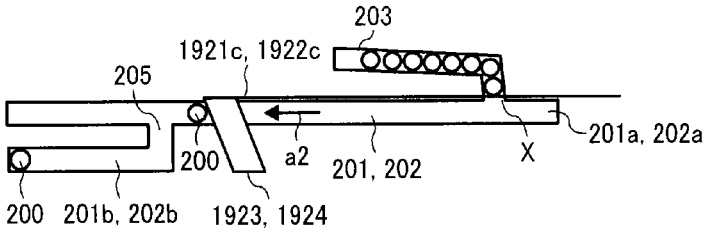
Figure 24F:
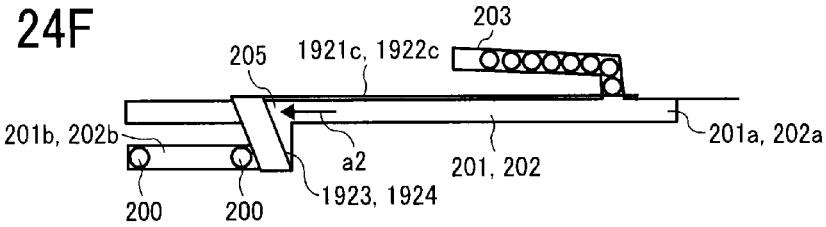

After then, as shown in FIG. 21C, the bonding area 96 on the upper side of the toner cartridge 490 is wrapped around the shaft 200 and supported thereby. Then, the cover 190A is pushed in the retracting direction a2, and the contact portions 1923 and 1924 move as shown in FIG. 24D. While the cover 190A thus moves, the toner cartridge 490 is opened and toner is supplied to the toner chamber 18. When the shaft 200 reaches the bifurcating portion 205 as shown in FIG. 24E and passes by the bifurcating portion 205, the shaft 200 falls toward the second end portions 201*b* and 202*b* of the rails 201 and 202 as shown in FIG. 24F. By pushing the cover 190A in the retracting direction a2 in this state, the used toner cartridge 9A can be compressed and stored in the storage compartment 198.

The fourth embodiment includes the following aspects.

In an image forming apparatus including an apparatus body in which the toner container is installable, a container supporter to support the toner container via a support portion of the toner container is provided.

Additionally, the image forming apparatus can include multiple container supporters each configured to support the toner container via a support portion of the toner container.

Additionally, the number of the container supporters is equal to or smaller than the number of the toner containers used to supply an amount of toner corresponding to a usage limit of the apparatus.

Additionally, the image forming apparatus can further include a conveyance member to move the container supporter in conjunction with movement of an openable and closable cover provided to the apparatus body.

Additionally, the container supporter supports the toner container such that two edges, skew to each other, of the tetrahedral containing portion are on upper and lower sides of the toner container.

Additionally, the apparatus body is provided with the container storage to accommodate the toner container, and an opener to open the toner container is provided in the container storage. The opener is disposed inside the container storage to open the toner container contained inside the container storage.

Additionally, the toner container includes a guide portion to introduce the opener when the opener tears the toner container.

Additionally, the image forming apparatus further includes a storage compartment positioned inside the container storage to store the used toner container after opened, and a member to transport the used toner container to the storage compartment.

Additionally, the member to transport the used toner container is designed to move in conjunction with movement of the cover. The member to transport the used toner container is designed to contact the toner container when moving the toner container.

It is to be noted that, elements and/or features of different example embodiments may be combined with each other and/or substituted for each other within the scope of this disclosure and appended claims.

Further, any one of the above-described and other example features of the present specification may be embodied in the form of a method.

Numerous additional modifications and variations are possible in light of the above teachings. It is therefore to be understood that, within the scope of the appended claims, the disclosure of this patent specification may be practiced otherwise than as specifically described herein.

What is claimed is:

1. A toner container comprising:

a substantially tetrahedral toner-containing portion having an openable edge to discharge toner contained in the toner-containing portion; and a reference fold along which the toner container is foldable after the openable edge is opened, the reference fold extends perpendicular from the openable edge to an apex of a triangular face and provided on medians of two triangular faces of the toner-containing portion adjoining each other along the openable edge.

2. The toner container according to claim 1, wherein the reference fold comprises a mountain fold line.

3. The toner container according to claim 1, wherein the toner-containing portion is constructed of a single sheet that is bonded in a first bonding area adjacent to the openable edge and at least two second bonding areas, and adhesiveness of the first bonding area is weaker than adhesiveness of the second bonding areas.

4. The toner container according to claim 3, wherein the second bonding areas are positioned in two parallel end portions of the single sheet, and borders between the second bonding areas and the toner-containing portion serve as the reference fold.

5. The toner container according to claim 1, further comprising an elastic member provided along the reference fold inside the containing portion, the elastic member deformed elastically and restorably.

6. The toner container according to claim 5, further comprising a support portion to maintain an angle between two adjacent faces of the tetrahedral containing portion.

7. The toner container according to claim 5, further comprising a support portion provided along and inside at least one edge of the tetrahedral toner-containing portion.

8. A process cartridge refillable with toner supplied from the toner container according to claim 1, the process cartridge comprising:

a container storage compartment to accommodate the toner container; and a compressor to contact and compress the toner container accommodated in the container storage compartment.

9. The process cartridge according to claim 8, further comprising:

a compressed container storage to accommodate the toner container after the toner container is compressed by the compressor; and a member to move the compressed toner container to the compressed container storage.

10. An image forming apparatus comprising the process cartridge according to claim 8 that is removably installed in the image forming apparatus.

11. An image forming apparatus comprising:

a container storage compartment to accommodate the toner container according to claim 1; and a compressor to contact and compress the toner container accommodated in the container storage compartment.

12. The image forming apparatus according to claim 11, further comprising:

a compressed container storage to accommodate the toner container compressed by the compressor; and a member to move the compressed toner container to the compressed container storage.

13. The image forming apparatus according to claim 11, wherein the toner includes oil-containing silica as an external additive thereto.

* * * * *